US006307140B1

(12) United States Patent
Iwamoto

(10) Patent No.: US 6,307,140 B1
(45) Date of Patent: Oct. 23, 2001

(54) MUSIC APPARATUS WITH PITCH SHIFT OF INPUT VOICE DEPENDENTLY ON TIMBRE CHANGE

(75) Inventor: Kazuhide Iwamoto, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/551,166

(22) Filed: Apr. 17, 2000

(30) Foreign Application Priority Data

Jun. 30, 1999 (JP) ..... 11-185044

(51) Int. Cl.[7] ..... G10H 1/02; G10H 1/06; G10H 1/38

(52) U.S. Cl. ..... 84/622; 84/626; 84/637; 84/659; 84/662; 84/669; 84/DIG. 22

(58) Field of Search ..... 84/613, 622–633, 84/637, 650–652, 659–665, 669, DIG. 22

(56) References Cited

U.S. PATENT DOCUMENTS

| | | | | |
|---|---|---|---|---|
| 5,301,259 | | 4/1994 | Gibson . | |
| 5,357,048 | | 10/1994 | Sgroi . | |
| 5,403,967 | * | 4/1995 | Takano | 84/613 |
| 5,410,603 | * | 4/1995 | Ishiguro et al. | 84/626 X |
| 5,428,708 | | 6/1995 | Gibson . | |
| 5,446,238 | | 8/1995 | Koyama . | |
| 5,563,361 | * | 10/1996 | Kondo et al. | 84/637 |
| 5,612,501 | * | 3/1997 | Kondo et al. | 84/637 |
| 5,642,470 | * | 6/1997 | Yamamoto et al. | 84/622 X |
| 5,652,401 | | 7/1997 | Nakamura et al. . | |
| 5,703,312 | * | 12/1997 | Takahashi et al. | 84/626 |
| 5,750,914 | * | 5/1998 | Takahashi | 84/626 |
| 5,811,707 | | 9/1998 | Kakehashi . | |
| 5,834,670 | * | 11/1998 | Yumura et al. | 84/622 X |
| 5,889,223 | * | 3/1999 | Matsumoto | 84/622 X |
| 5,998,724 | * | 12/1999 | Takeuchi et al. | 84/622 |
| 6,101,469 | * | 8/2000 | Curtin | 84/659 X |
| 6,121,531 | * | 9/2000 | Kato | 84/626 X |

FOREIGN PATENT DOCUMENTS

| | | |
|---|---|---|
| 00 10 7893 | 10/2000 | (EP) . |
| 09316492 | 5/1999 | (JP) . |
| 09357219 | 7/1999 | (JP) . |
| WO 96/22592 | 7/1996 | (WO) . |

* cited by examiner

*Primary Examiner*—Stanley J. Witkowski
(74) *Attorney, Agent, or Firm*—Morrison Foerster LLP

(57) ABSTRACT

A music apparatus is constructed for receiving an input signal composed of either of a voice signal and a tone signal and for processing the input signal based on a timbre change command signal to generate at least one channel of an output signal. In the music apparatus, a reference pitch designation section designates a reference pitch. An output signal generation section receives the input signal, the timbre change command signal and the reference pitch designated by the reference pitch designation section for changing a timbre of the input signal in accordance with the timbre change command signal, and for changing a pitch of the input signal above or below the reference pitch in accordance with the timbre change command signal, thereby generating the output signal having the changed timbre and the changed pitch.

22 Claims, 17 Drawing Sheets

FIG. 2 (a)

| | PART NAME |
|---|---|
| KEYBOARD PLAY | VOICE R1 |
| | VOICE R2 |
| | VOICE L |
| AUTOMATIC ACCOMPANIMENT | RHYTHM SUB |
| | RHYTHM MAIN |
| | BASS |
| | CHORD 1 |
| | CHORD 2 |
| | PAD |
| | PHRASE 1 |
| | PHRASE 2 |
| VOCAL HARMONY | LEAD(MICROPHONE) |
| | HARMONY |

FIG. 2 (b)

| | PART NAME |
|---|---|
| KEYBOARD PLAY | VOICE R1 |
| | VOICE R2 |
| | VOICE L |
| AUTOMATIC ACCOMPANIMENT (SONG) | TRACK 1 |
| | TRACK 2 |
| | TRACK 3 |
| | TRACK 4 |
| | · |
| | · |
| | TRACK 15 |
| | TRACK 16 |
| VOCAL HARMONY | LEAD(MICROPHONE) |
| | HARMONY |

FIG. 5 (a)
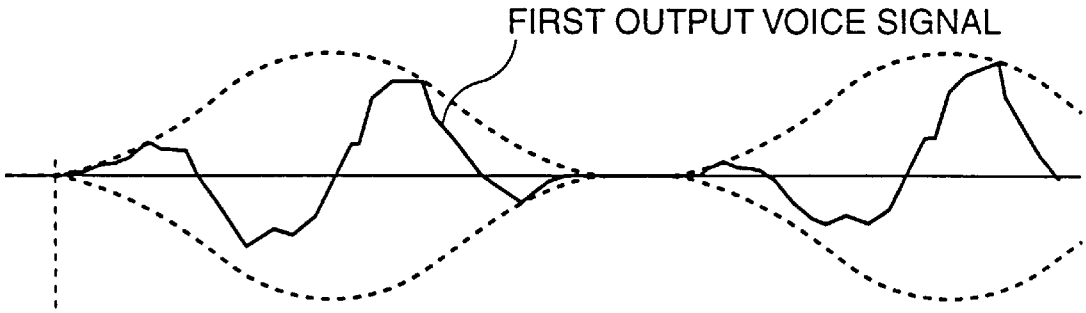
FIG. 5 (b)
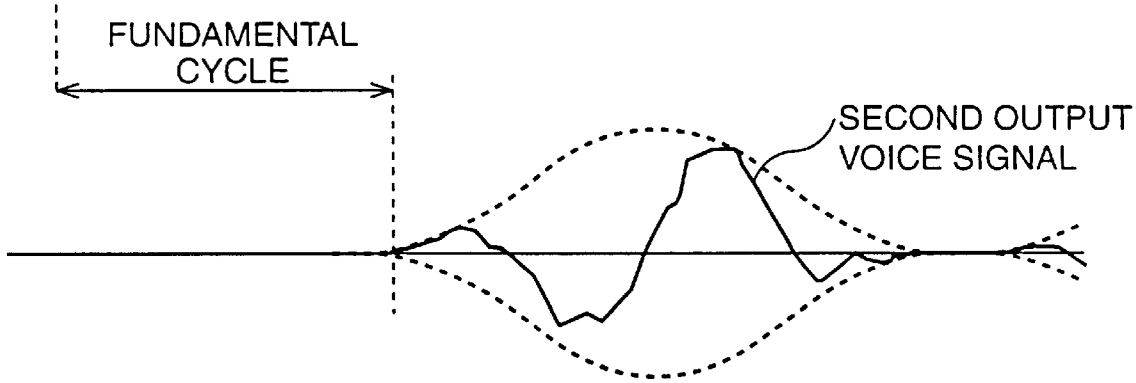
FIG. 6
| HARMONY MODE | HARMONY TYPE |
|---|---|
| VOCODER HARMONY MODE | FIG.7 |
| CHORDAL HARMONY MODE | FIG.10 |
| DETUNE HARMONY MODE | FIG.8 |
| CHROMATIC HARMONY MODE | FIG.9 |

FIG. 7

| HARMONY MODE | HARMONY TYPE |
|---|---|
| VOCODER HARMONY MODE | NO TRANSPOSITION |
| | AUTO-TRANSPOSITION |
| | SHIFT−3 OCTAVES |
| | SHIFT−2 OCTAVES |
| | SHIFT−1 OCTAVE |
| | SHIFT+1 OCTAVE |
| | SHIFT+2 OCTAVES |
| | SHIFT+3 OCTAVES |

FIG. 8

| DETUNE HARMONY MODE | | |
|---|---|---|
| HARMONY TYPE | VOICE 1 | VOICE 2 |
| TRIOLOW | −7 CENTS | +7 CENTS |

FIG. 9

| CHROMATIC HARMONY MODE | | |
|---|---|---|
| HARMONY TYPE | VOICE 1 | VOICE 2 |
| OCTAVE BELOW | BELOW 1 OCTAVE | − |
| OCTAVE ABOVE | ABOVE 1 OCTAVE | − |

FIG. 10

| CHORDAL HARMONY MODE | | |
|---|---|---|
| HARMONY TYPE | ONE VOICE | TWO VOICES |
| DuetAbove | VOICE 1 IS ABOVE | – |
| DuetBelow | VOICE 1 IS BELOW | – |
| DuetAbove+Bass | VOICE 1 IS BASS | VOICE 2 IS ABOVE |
| TrioAbove | VOICE 1 IS ABOVE | VOICE 2 IS ABOVE |
| TrioAbove&Below | VOICE 1 IS BELOW | VOICE 2 IS ABOVE |
| TrioBelow | VOICE 1 IS BELOW | VOICE 2 IS BELOW |
| DuetAbove+OctaveAbove | VOICE 1 IS ABOVE | VOICE 2 IS ABOVE |
| DuetBelow+Bass | VOICE 1 IS BASS | VOICE 2 IS BELOW |
| DuetBelow+OctaveBelow | VOICE 1 IS BELOW | VOICE 2 IS BELOW |
| DiatonicAbove | VOICE 1 IS ABOVE | VOICE 2 IS ABOVE |
| DiatonicAbove&Below | VOICE 1 IS BELOW | VOICE 2 IS ABOVE |
| DiatonicBelow | VOICE 1 IS BELOW | VOICE 2 IS BELOW |
| JazzAbove | VOICE 1 IS ABOVE | VOICE 2 IS ABOVE |
| JazzAbove&Below | VOICE 1 IS BELOW | VOICE 2 IS ABOVE |
| JazzBelow | VOICE 1 IS BELOW | VOICE 2 IS BELOW |
| Unison | VOICE 1 IS THE SAME | OCTAVE SHIFT |
| 3 Unison | OCTAVE SHIFT | OCTAVE SHIFT |

FIG. 11 (a)

| LEAD TONE NAME | CHORD TYPE | VOICE 1 | VOICE 2 |
|---|---|---|---|
| C | Major | E−1 | — |
| C# | | E−1 | — |
| D | | G−1 | — |
| D# | | G−1 | — |
| E | | C0 | — |
| F | | C0 | — |
| F# | | C0 | — |
| G | | E0 | — |
| G# | | E0 | — |
| A | | E0 | — |
| A# | | E0 | — |
| B | | E0 | — |

FIG. 11 (b)

| LEAD TONE NAME | CHORD TYPE | VOICE 1 | VOICE 2 |
|---|---|---|---|
| C | Major | A−1 | E0 |
| C# | | A#−1 | E0 |
| D | | A−1 | E0 |
| D# | | C0 | A0 |
| E | | C0 | A0 |
| F | | D0 | A0 |
| F# | | D#0 | C1 |
| G | | E0 | C1 |
| G# | | E0 | C1 |
| A | | E0 | C1 |
| A# | | G0 | E1 |
| B | | G0 | E1 |
| C | minor | G−1 | D#0 |
| C# | | G−1 | D#0 |
| D | | G−1 | D#0 |
| D# | | C0 | G0 |
| E | | C0 | G0 |
| F | | D0 | C1 |
| F# | | D#0 | C1 |
| G | | D#0 | C1 |
| G# | | F0 | D#1 |
| A | | G0 | D#1 |
| A# | | G0 | D#1 |
| B | | G0 | D#1 |

FIG. 12

| PARAMETER | VALUE |
|---|---|
| HARMONY TYPE | (NOT SHOWN) |
| HARMONY GENDER TYPE<br>LEAD GENDER TYPE<br>LEAD GENDER DEPTH<br>LEAD PITCH CORRECTION<br>AUTO UPPER GENDER THRESHOLD<br>AUTO LOWER GENDER THRESHOLD<br>UPPER GENDER DEPTH<br>LOWER GENDER DEPTH<br>LEAD/HARMONY BALANCE | off, auto<br>off, unis, male, fem<br>−64～+63<br>free, correct<br>0～12<br>0～12<br>−64～+63<br>−64～+63<br>L63>H～L=H～L<H63 |
| VIBRATO DEPTH<br>VIBRATO RATE<br>VIBRATO DELAY | 0～127<br>0～127<br>0～127 |
| HARMONY VIBRATO RATE<br>HARMONY VIBRATO DEPTH<br>HARMONY VIBRATO DELAY | 0～127<br>0～127<br>0～127 |
| DETUNE MODULATION | 0～127 |
| HARMONY 1 VOLUME<br>HARMONY 2 VOLUME<br>HARMONY 1 PAN<br>HARMONY 2 PAN<br>HARMONY 1 DETUNE<br>HARMONY 2 DETUNE<br>LEAD VIBRATO RATE<br>LEAD VIBRATO DEPTH<br>LEAD VIBRATO DELAY | 0～127<br>0～127<br>Randam,L63>R～C～L>R63<br>Randam,L63>R～C～L>R63<br>−64cent～0～+63cent<br>−64cent～0～+63cent<br>0～127<br>0～127<br>0～127 |
| HARMONY PART | off, Upper, Lower |
| PITCH-TO-NOTE SWITCH<br>PITCH-TO-NOTE PART | off, on<br>R1, R2, Left, Lead, Upper |
| HARMONY ADDITIONAL REVERBERATION DEPTH | 0～127 |
| HARMONY ADDITIONAL CHORUS DEPTH | 0～127 |
| VARIATION PARAMETER<br>VARIATION VALUE | (NOT SHOWN)<br>(NOT SHOWN) |

FIG. 13

| KIT NAME | MODE | HARMONY TYPE | HARMONY GENDER TYPE | LEAD GENDER TYPE |
|---|---|---|---|---|
| Standard Duet | Chordal | DuetAbove | Off | Off |
| Girl in Duet | | DuetAbove | Auto | Off |
| Lisa and Tina | | DuetAbove | Auto | Female |
| Country Men | | DuetAbove | Off | Off |
| Falsetto Duet | | DuetBelow | Off | Off |
| A Capella Boy | | DuetAbove+Bass | Auto | Off |
| A Capella Mix | | DuetAbove+Bass | Auto | Off |
| Men Choir | | TrioAbove | Off | Off |
| Women Choir | | TrioAbove | Auto | Off |
| Country Girls | | TrioAbove | Auto | Off |
| Closed Choir | | TrioAbove&Below | Off | Off |
| Mixed Choir | | TrioAbove&Below | Auto | Off |
| Falsetto Trio | | TrioBelow | Off | Off |
| Sing B+G | | DuetAbove+ OctaveAbove | Off | Off |
| Dream Girls | | DuetAbove+ OctaveAbove | Auto | Off |
| Fal A Capella | | DuetBelow+Bass | Off | Off |
| Barbershop | | DuetBelow+ OctaveBelow | Off | Off |
| Diatonic Jazz | | DiatonicAbove | Off | Off |
| Diatonic Girl | | DiatonicAbove | Auto | Off |
| A Capella Dia | | DiatonicAbove& Below | Off | Off |
| Falsetto Dia | | DiatonicBelow | Off | Off |
| JazzMenChoir | | JazzAbove | Off | Off |
| JazzWomenCho | | JazzAbove | Auto | Off |
| JazzClosedCho | | JazzAbove&Below | Off | Off |
| JazzMixedCho | | JazzAbove&Below | Auto | Off |
| Falsetto Jazz | | JazzBelow | Off | Off |
| 2 Unison Low | | Unison | Off | Off |
| 2 Unison High | | Unison | Off | Off |
| 3 Unison Low | | 3Unison | Off | Off |
| 3 Unison High | | 3Unison | Off | Off |
| Voice & Inst | | DuetAbove | Off | Off |

FIG. 14

| KIT NAME | MODE | HARMONY TYPE | HARMONY GENDER TYPE | LEAD GENDER TYPE |
|---|---|---|---|---|
| Vocoder Auto Upper | Vocoder | AutoTranspose | Off | Off |
| Vocoder Auto Lower | | AutoTranspose | Off | Off |
| Vocoder Mode Upper | | NoTranspose | Off | Off |
| Vocoder Mode Lower | | +1OctaveTranspose | Off | Off |
| Vocoder Girl Upper | | NoTranspose | Auto | Female |
| Vocoder Girl Lower | | +2OctaveTranspose | Auto | Female |
| Vocoder Pitch Upper | | NoTranspose | Off | Unison |
| Vocoder Pitch Lower | | +1OctaveTranspose | Off | Unison |
| Karaoke Auto | | AutoTranspose | Off | Off |
| Karaoke Mode | | NoTranspose | Off | Off |
| Karaoke Girl | | NoTranspose | Auto | Female |
| Karaoke Pitch | | NoTranspose | Off | Unison |
| Sing the Bass | Chromatic | OctaveBelow | Off | Off |
| Speedy Mouse | | OctaveAbove | Off | Unison |
| VocoderXG | Vocoder | NoTranspose | Off | Off |
| ChordalXG | Chordal | DuetAbove | Off | Off |
| DetuneXG | Detune | TrioLow | Off | Off |
| ChromaticXG | Chromatic | OctaveBelow | Off | Off |

MUSIC APPARATUS WITH PITCH SHIFT OF INPUT VOICE DEPENDENTLY ON TIMBRE CHANGE

BACKGROUND OF THE INVENTION

The present invention relates to a processing apparatus of a voice signal or tone signal for outputting vocal harmony.

A processing apparatus for detecting, in real time, the pitch of a user's input voice signal (a lead voice signal), and for adding a harmonic voice signal to the voice signal to be output is well known and is described in Japanese Unexamined Patent Publication No. Hei 11-133990. The pitch of the input voice signal is changed, and the resultant signal is output through a loudspeaker as a harmonic voice. At this time, various sound effects are added to the harmonic voice signal to provide a variety of harmonic voice variations.

In order for this apparatus to be provided as a product, a further improvement is needed relative to the alteration of the sound quality of a lead voice signal, the alteration of sound quality and the conversion of the pitch for a harmonic voice signal, and the production of a user interface for easily performing the alterations and the pitch conversion and for applying sound effects.

SUMMARY OF THE INVENTION

To resolve the above problem, it is one object of the present invention to provide a processing apparatus of a voice signal or a tone signal that can easily perform a clear timbre change for an input signal and perform various input signal pitch conversions, or can easily apply sound effects to an input signal.

In a first aspect of the invention, a music apparatus is constructed for receiving an input signal composed of either of a voice signal and a tone signal and for processing said input signal based on a timbre change command signal to generate at least one channel of an output signal. The music apparatus comprises a reference pitch designation section that designates a reference pitch, and an output signal generation section receptive of said input signal, said timbre change command signal and said reference pitch designated by said reference pitch designation section for changing a timbre of said input signal in accordance with said timbre change command signal, and for changing a pitch of said input signal above or below said reference pitch in accordance with said timbre change command signal, thereby generating the output signal having the changed timbre and the changed pitch. Preferably, the output signal generation section changes the pitch of the input signal above the reference pitch when the timbre of the input signal is changed by converting an original formant of the input signal to a female formant, and the output signal generation section changes the pitch of the input signal below the reference pitch when the timbre of the input signal is changed by converting an original formant of the input signal to a male formant.

According to the first aspect of the present invention, since at the same time as the timbre of the input signal is changed, the pitch of the output signal is altered so that it is higher or lower than the designated reference pitch, the change in the timbre is more easily discerned than it is when the pitch of the input signal is adjusted to that of the reference pitch. As an example of the clear difference that can be provided by the alteration of sound quality, when the quality of the input voice is changed to generate a lead or a harmonic voice signal, by a formant conversion into female voice, the pitch of the input signal is raised until it is higher than the reference pitch, while for a formant conversion into male voice, the pitch is reduced until it is lower than the reference pitch.

In a second aspect of the invention, a music apparatus is constructed for receiving an input signal composed of either of a voice signal and a tone signal and for processing said input signal in accordance with a timbre change command signal to generate at least one channel of an output signal. The music apparatus comprises a pitch detection section that detects a pitch of said input signal, and an output signal generation section receptive of said input signal, said timbre change command signal and said pitch of said input signal that is detected by said pitch detection section for changing a timbre of said input signal based on said timbre change command signal and for increasing or decreasing said pitch of said input signal based on said timbre change command signal, thereby generating said output signal having the changed timbre and the changed pitch. Preferably, the output signal generation section increases the pitch of the input signal when the timbre of the input signal is changed by converting an original formant of the input signal to a female formant, and the output signal generation section decreases the pitch of the input signal when the timbre of the input signal is changed by converting an original formant of the input signal to a male formant.

According to the second aspect of the present invention, since the pitch of the input signal is changed at the same time when the timbre is changed, the alteration of the timbre can be more clearly distinguished. As an example of the clear difference that can be provided for the alteration of sound quality, when the quality of the input voice is altered to generate a lead voice signal or a harmonic voice signal, by formant conversion into female voice, the pitch is raised, while for formant conversion into male voice, the pitch is lowered.

In a third aspect of the invention, a music apparatus is constructed for receiving an input signal composed of either of a voice signal and a tone signal and for processing said input signal in accordance with a chord designation signal to generate at least one channel of an output signal. The music apparatus comprises a pitch conversion table stored for use in conversion of a pitch according to a chord, a pitch determination section receptive of at least the chord designation signal which designates a chord for referring to said pitch conversion table to determine a pitch of said output signal based on the designated chord, and an output signal generation section receptive of said input signal for changing a pitch of said input signal to the pitch determined by said pitch determination section thereby generating said output signal having the determined pitch. Preferably, the music apparatus comprises a plurality of pitch conversion tables corresponding to a plurality of harmony types which can be selected to determine a particular harmonic relation between said input signal and said output signal, wherein said pitch determination section refers to a pitch conversion table corresponding to the selected harmony type to determine a pitch of said output signal, and said output signal generation section generates said output signal having the determined pitch in parallel to said input signal to establish the particular harmonic relation therebetween.

According to the third aspect of the present invention, even when many chords are designated, by using the pitch conversion table, only a simple structure is required to determine the pitches of a variety of harmonic voices.

In a fourth aspect of the invention, a music apparatus is constructed for receiving an input signal composed of either of a voice signal and a tone signal and for processing said input signal in accordance with a kit designation signal to generate at least one channel of an output signal. The music apparatus comprises a memory section that stores a plurality of parameter kits, each of which is constituted by a plurality of parameters used for characterizing said output signal and each of which includes at least a parameter used for controlling a pitch of said output signal, a parameter output section receptive of said kit designation signal that designates one of the parameter kits for referring to said designated parameter kit to output therefrom at least said parameter used for controlling the pitch of said output signal, and an output signal generation section that receives said input signal and that changes a pitch of said input signal based on at least said parameter that is output by said parameter output section, thereby generating said output signal having the changed pitch. Preferably, said memory section stores a plurality of parameter kits in correspondence to a plurality of harmony modes including a vocoder harmony mode, a chordal harmony mode, a detune harmony mode and a chromatic harmony mode, each of which is used for characterizing a harmonic relation of said output signal to said input signal, said parameter output section refers to said designated parameter kit to output therefrom said parameters used for controlling said output signal, and said output signal generation section generates said output signal in parallel to said input signal to establish the harmonic relation therebetween according to the designated parameter kit.

According to the fourth aspect of the present invention, since the parameters that characterize the output signal, such as the pitch of the output signal, can be collectively set by using the kit designation signal, a variety of parameter setups can be easily performed.

In a fifth aspect of the invention, a music apparatus is constructed for receiving an input signal composed of either of a voice signal and a tone signal and for processing said input signal to generate at least one channel of an output signal. The music apparatus comprises an effect setting section that sets parameters that are related to one or more sound effects to be applied to said output signal, an effect instruction section that instructs application of at least one of said sound effects, and an effect applying section operative based on said parameters that are set by said effect setting section and that are related to said sound effect for processing said input signal to generate said output signal applied with said sound effect that is designated by said effect instruction section. Preferably, said effect instruction section is manually operable to instruct application of a sound effect to said output signal independently from said input signal, and said effect applying section generates said output signal in parallel to said input signal while applying said sound effect designated by said effect instruction section to said output signal independently from said input signal.

According to the fifth aspect of the present invention, without changing the setup of the effect setting section, whether a desired sound effect is to be applied or not can be determined simply by touching the effect instruction section.

BRIEF DESCRIPTION OF THE DRAWINGS

FIGS. 2(*a*) and 2(*b*) are diagrams for explaining the music play performed by the voice signal/tone signal processing apparatus of FIG. 1.

FIGS. 5(*a*) and 5(*b*) are other diagrams for explaining the example process performed by the formant modifier and the pitch shifter shown in FIG. 1.

FIG. 6 is a diagram for explaining a harmony mode.

FIG. 7 is a diagram for explaining the types of vocoder harmony modes.

FIG. 8 is a diagram for explaining types of detune harmony modes.

FIG. 9 is a diagram for explaining types of chromatic harmony modes.

FIG. 10 is a diagram for explaining types of chordal harmony modes.

FIGS. 11(*a*) and 11(*b*) are diagrams for explaining contents of a conversion table for tone names used in the chordal harmony modes.

FIG. 12 is a diagram for explaining parameters used by the voice signal/tone signal processing apparatus of FIG. 1.

FIG. 13 is a diagram showing harmony kits.

FIG. 14 is another diagram showing harmony kits.

DETAILED DESCRIPTION OF EMBODIMENTS

Figure 1:
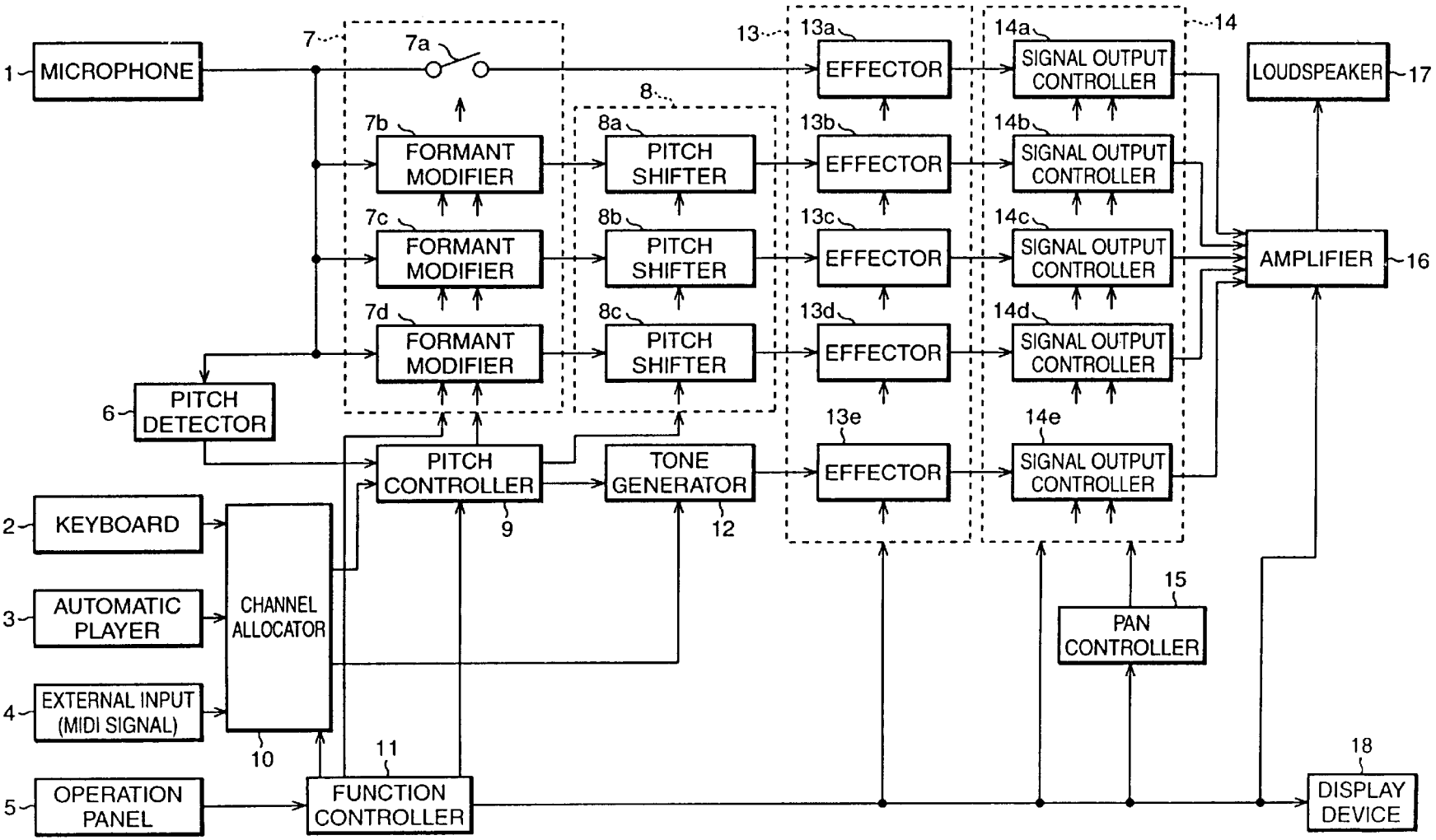
FIG. 1 is a functional block diagram for explaining a voice signal/tone signal processing apparatus according to one embodiment of the present invention.

FIG. 1 is a functional block diagram for explaining a voice signal/tone signal processing apparatus according to one embodiment of the present invention. The overall arrangement will now be described.

In FIG. 1, reference numeral 1 denotes a microphone, used as an input voice unit; 2, a keyboard, by which play data are input by the depression of keys; 3, an automatic player, for reading stored play data; 4, an external input unit, for receiving MIDI (Musical Instrument Digital Interface) signals; 5, an operation panel, for setting functions or parameters; and 6, a pitch detector for detecting the pitch of input voice (hereinafter referred to as a vocal pitch).

Reference numeral 7 is a formant modifier device for controlling the quality of input voice. For example, reference numeral 7*a* denotes a switch for determining whether an input voice is to be passed while unchanged; 7*b*, a first formant modifier for changing the formant of either a lead voice or a harmonic voice; and 7*c* and 7*d*, second and third formant modifiers for changing the formant of a harmonic voice. The operations of the first to the third formant modifiers 7*b* to 7*d* include passive one wherein the operation is halted and no formant change is effected.

Reference numeral 8 denotes a pitch shifter device for changing the pitch of an input signal, and reference numerals 8*a* to 8*c* denote first to third pitch shifters. For example, the first pitch shifter 8*a* changes the pitches of either lead voices or harmonic voices, and the second and third pitch shifters 8*b* and 8*c* change the pitches of harmonic voices.

Reference numeral 9 denotes a pitch controller for using the pitch of the input voice received from the pitch detector 6, or the pitch of play data that is received from a channel allocator 10 to control the pitches of the signals that are received by the pitch shifter device 8 and a tone generator 12.

Reference numeral 10 denotes a channel allocator for selectively allocating, as input controls for the pitch controller 9 and the tone generator 12, the input controls via the keyboard 2, the automatic player 3 and the external input unit 4. Reference numeral 11 denotes a function controller for the overall control of the individual functional blocks, and 12, a tone generator for generating a music tone signal.

Reference numeral 13 denotes an effector device, and 13*a* to 13*e,* first to fifth effectors. The first effector 13*a* provides sound effects for lead voices, the second effector 13*b* provides sound effects for lead voices or for harmonic voices, the third and fourth effectors provide sound effects for harmonic voices, and the fifth effector 13*e* provides sound effects for musical tones.

Reference numeral 14 denotes a signal output controller device, which is controlled by the function controller 11. Reference numeral 14*a* to 14*e* denote first to fifth signal output controllers. The first signal output controller 14*a* controls volume ratios relative to the lead voice, the second signal output controller 14*b* controls volume ratios relative to either lead voice or harmonic voices, the third and fourth signal output controllers 14*c* and 14*d* control volume ratios relative to harmonic voices, and the fifth signal output controller 14*e* controls volume ratios relative to musical tones. Further, whether the individual signal channels are to be output is also determined. A harmonic voice signal is output with a lead voice signal output by either the signal output controller 14*a* or 14*d.* Further, a harmonic voice signal can be output independently, without a lead voice signal being output.

Reference numeral 15 denotes a pan controller; 16, an amplifier for mixing and amplifying the outputs of the first to fifth signal output controllers 14*a* to 14*e* and for outputting a stereo or 3D sound voice signals or tone signals; 17, one or more loudspeakers; and 18, a liquid crystal display device on an operating panel.

The outline of the operation for this embodiment will now be described. The output of the microphone 1 is transmitted to the formant modifier device 7 and the pitch detector 6. The exemplified formant modifier device 7 can output a maximum of four channels: one channel is for outputting an unchanged voice that is input, and three channels are for changing the formants of input voices and outputting the results. When the input voice is not unchanged by turning off the switch 7*a,* the first formant modifier 7*b* may change the formant of the lead voice. In this case, two channels of harmonic voices are output.

The outputs of the first to third formant modifiers 7*b* to 7*d* are transmitted to the first to third pitch shifters 8*a* to 8*c*. Sound effects are provided by the first to the fourth effectors 13*a* to 13*c* for the output of the switch 7*a,* the outputs of the first to third pitch shifters 8*a* to 8*c,* and the individual output channels of the tone generator 12. Further, the first to fifth signal processors 14*a* to 14*e* output only a specific one or more channels, and the pan controller 15 performs weighting (control of a mixture ratio) to determine the localization of each of the signal channels. The output of the signal output controller 14*a* serves as a lead voice signal; the output of the signal output controller 14*b* serves as either a lead voice signal or a harmonic voice signal; the outputs of the signal output controllers 14*c* and 14*d* serve as harmonic voice signals; and the output of the signal output controller 14*e* serves as a music tone signal. These signals are mixed by the amplifier 16, and the resultant signal is released through the loudspeaker 17.

The pitch detector 6 detects a vocal pitch by using a well known technique, such as zero-cross, in a voice analysis field, and outputs the vocal pitch to the pitch controller 9. Based on the vocal pitch , etc., the pitch controller 9 calculates the pitch after the formant conversion, and outputs it to the pitch shifter device 8, the formant modifier device 7, the tone generator 12 and the effector device 13. Depending on the mode that is set, the pitch controller 9 calculates the pitch by using only the pitch of a harmony part that is output by the channel allocator 10.

While a specific control mode for the pitch shifter device 8 will be described later, the pitch controller 9 has a function whereby control of the formant modifier device 7 and the effector device 13 is exercised, and a function whereby the type of sound effect (including the sound quality) that is to be applied to a harmonic voice is changed, and/or the degree of a sound effect is changed in accordance with a pitch difference between the vocal pitch of the input voice and a harmonic voice whose pitch is changed. As a result, upon receiving the voice produced by a user, a variety of sound effects can be applied to a harmonic voice, or an appropriate sound effect in consonance with a pitch difference for the pitch of the user's voice can be automatically applied to a harmonic voice.

The channel allocator 10 assigns, as a harmony part, a signal received from the keyboard 2, the automatic player 3 or the external input unit 4, and outputs it to the pitch controller 9, as is described above. Also, the channel allocator 10 allocates other play data to a musical tone channel, and controls the pitch of a musical tone that is generated by the tone generator 12.

The output of the operation panel 5 controls, via the function controller 11, the functions of the formant modifier device 7, the pitch controller 9, the channel allocator 10, the tone generator 12, the effector device 13, the signal output controller device 14, the pan controller 15, the amplifier 16, and the display device 18.

With the above described arrangement and operation, a desirable sound effect is applied to a lead voice that corresponds to a voice signal input at the microphone 1, a harmonic voice that is generated based on the input voice, and a musical tone, and at least one of these tones is selected and is released after the mixing has been performed. As will be described later while referring to FIG. 12, etc., the sound effects to be provided include gender (the type and the depth of sound quality, such as a male voice, a female voice or a neutral voice), vibrato (the change ratio of the depth of a vibrato to a vibrato cycle, and the delay time before the vibrato starts), tremolo, volume, pan (localization), detune (detune of a harmonic voice in a mode other than a detuning harmonic mode, which will be described later), reverberation, or chorus.

In order to easily understand the functions, in FIG. 1, the effector is in charge of the application of a sound effect; however, a sound effect used for changing the pitch, such as vibrato or detune, can be provided at the same time as the pitch is changed by the pitch shifter device 8. The volume control and the pan can be performed by the signal output controller 14. The effect of gender is provided by the formant modifier device 7.

The operation panel 5 and the function controller 11 are so designed that a sound effect to be applied to a lead voice signal that corresponds to a voice signal provided by a user, and a sound effect to be applied to a harmonic voice signal can be independently set. Therefore, the user can employ the formant modifier device 7 and the sound effector device 13 to set mutually different sound effects, e.g., to set different types of sound effects or to set different intensities for the sound effect. For example, the depth of a sound effect to be applied to a harmonic voice signal can be greater than the depth of a sound effect for a lead voice signal, or a random pan can be performed for a harmonic voice signal, while the localization of a sound image is not changed for a lead voice signal.

Furthermore, in the default state, the function controller 11 permits the formant modifier device 7 and the effector device 13 to constantly provide different sound effects for a lead voice signal and a harmonic voice signal. As a result, a clear harmonic voice can be generated for the original voice produced by a user.

In the illustrated example, a total of four channels are provided as the channels of lead voice and harmonic voice signals. The number of signal channels may be decreased or increased. A lead voice may be transmitted to the first signal output controller 14*a* without changing the formant or without applying any sound effect. The first formant modifier 7*b*, the first pitch shifter 8*a*, the second effector 13*b* and the second signal output controller 14*b* may be defined as constituting a special block for processing a lead voice signal. In this case, the system constituted by the switch 7*a*, the first effector 13*a* and the first signal output controller 14*a* is not required. The signal output controller device 14 can select one or more arbitrary signal channels from among a lead voice signal, a plurality of harmonic voice signals and a musical tone signal, and can transmit them to the amplifier 16, and then they are released through the loudspeaker 7.

Since the analog signal processing and the digital signal processing are not discriminated in the functional block diagram, an A/D converter and a D/A converter are not shown. As an example, an analog signal entered at the microphone 1 is converted into a digital signal by the A/D converter, and the digital signal is transmitted to the subsequent blocks. The signal output controller 14 weights a plurality of outputs, adds altogether their digital values, and outputs the result to the amplifier 16 via the D/A converter.

FIG. 2 is a diagram for explaining the music play operation performed by the voice signal/tone signal processing apparatus in FIG. 1. FIG. 2(*a*) is a diagram for explaining parts that are performed in an automatic accompaniment mode (style mode); and FIG. 2(*b*) is a diagram for explaining parts that are performed in an automatic play mode (song mode). In either mode, the vocal harmony is output. The vocal harmony is provided by the input voice part that is entered at the microphone 1 and by the harmony part that serves as the playing input for a harmony part altogether or independent of the input voice part.

In FIG. 1 described above, the allocation of the parts is established using the operation panel 5, and is performed by the channel allocator 10, which is controlled by the function controller 11.

Figure 3:
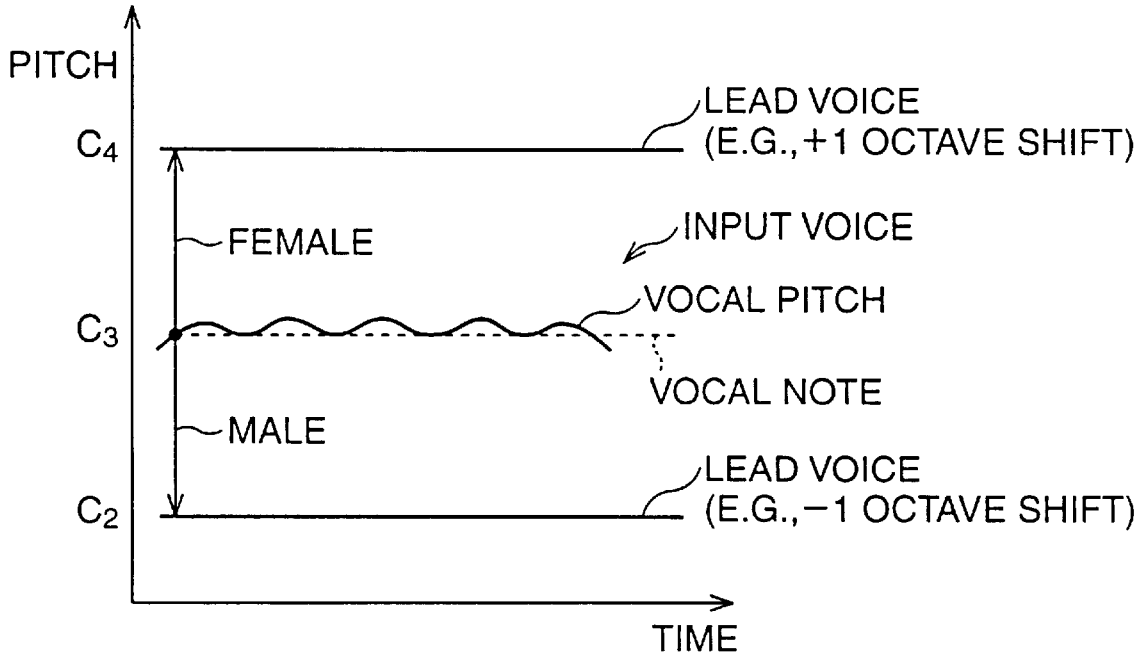
FIG. 3 is a diagram for explaining a lead voice that is generated by the voice signal/tone signal processing apparatus of FIG. 1.

FIG. 3 is a diagram for explaining a lead voice that is generated by the voice signal/tone signal processing apparatus in FIG. 1. Conventionally, in principle, a sound effect is created with a lead voice signal, while the pitch of an input voice entered at the microphone 1 is not changed. As a result, when the formant is changed, the gender (sound quality) of the lead voice signal may be changed. However, merely by changing a formant, it is difficult to provide a clear aural change, such as from a male voice to a female voice.

Therefore, when a gender change Is designated, the pitch of a lead voice signal is so altered that an appropriate gender result is provided, or the result falls within an appropriate range. As is illustrated, if a female voice is designated when the pitch of the input voice (vocal pitch) is substantially $C_3$, the input voice is transposed +1 octave, and the lead voice signal is output while the obtained $C_4$ is defined as the play data. When a male voice is designated, the input voice is transposed −1 octave, and the lead voice signal is output while the obtained $C_2$ is defined as the play data.

The transposition span is not fixed to ±1 octave, and may be ±3 or ±5 degrees. As well as the change in the sound quality, the transposition span (pitch shift distance) can be changed by the operation panel 5.

For the vocal pitch of the lead voice signal, when pitch correction is designated, a vocal note is calculated whose pitch is nearest to the vocal pitch as a result of a comparison of wavelengths, and the pitch of the vocal note is obtained. Similarly, when pitch correction is designated at the time of a transposition, the transposed pitch is rounded off for assignment of a specific pitch name.

The formant change and the pitch conversion of the lead voice signal described above are respectively performed by the formant modifier 7*b* and the pitch shifter device 8 in FIG. 1. At this time, the switch 7*a* is in the OFF state.

In the above explanation, when a change of gender is designated, the pitch of a lead voice signal is changed by using, as a reference pitch, the pitch of the voice that is input (vocal pitch). However, if a melody channel is set, and if play data are input for a part (may not be merely a part entered at a keyboard, but may also be a part in a song track) that is allocated as the melody channel, the pitch of the lead voice signal is determined according to the pitch of the playing input for the melody channel. Therefore, when a change of gender is designated, the pitch is also transposed positively or negatively while the pitch of the playing input for the melody channel is used as a reference pitch. As a result, the change in the sound quality can be made clearer than when the pitch of the playing input for the melody channel is used as the pitch of the lead voice.

A method for a formant change and a pitch conversion of a lead voice signal will be briefly explained. For a harmonic voice signal, the formant change and the pitch conversion are performed in the same manner.

Figure 4:
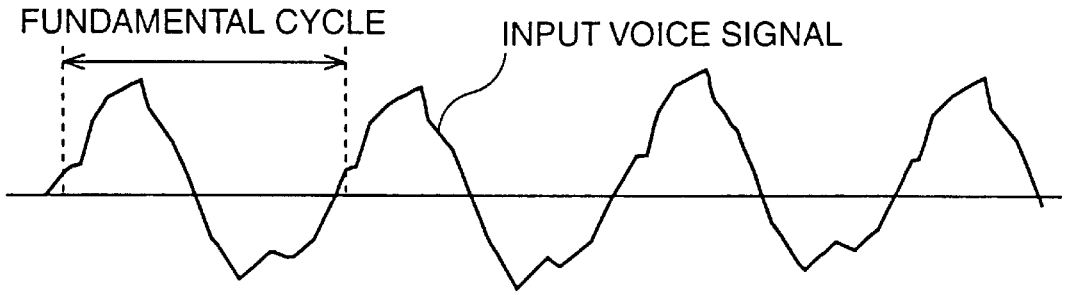
FIGS. 4(*a*)–4(*d*) are diagrams for explaining an example process performed by a formant modifier and a pitch shifter shown in FIG. 1.
Figure 4:
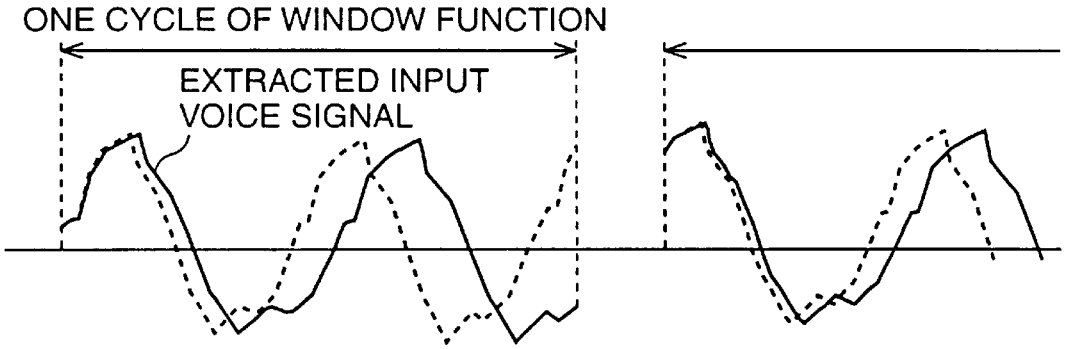
Figure 4:
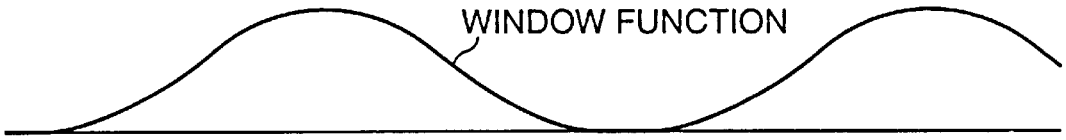
Figure 4:
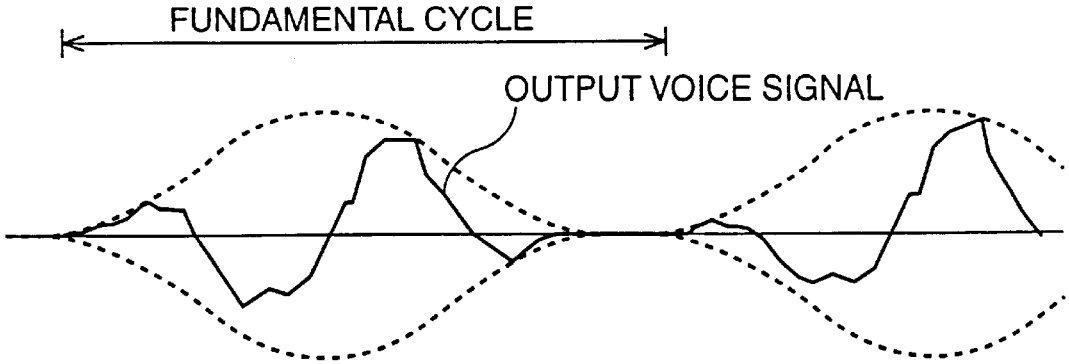

FIG. 4 is a first diagram for explaining an example processing performed by the formant modifier device 7 and the pitch shifter device 8 in FIG. 1. In this diagram, the fundamental cycle of an output voice signal is longer than the fundamental cycle of an input voice signal. In FIG. 4(*a*) is shown an input voice signal waveform; in FIG. 4(*b*) is shown an input voice signal that has been extracted; in FIG. 4(*c*) is shown a window function; and in FIG. 4(*d*) is shown an output voice signal.

A phonemic segment is extracted from an input voice signal, and is extended or compressed to change the formant. In addition, a phonemic segment is inserted at the pitch interval of the lead voice signal to change the formant and the pitch.

In accordance with the fundamental cycle of the input voice signal obtained by the pitch detector 6 in FIG. 1, the input voice signal is extracted and is multiplied by the window function. While the waveform obtained by multiplication is employed as the element, the voice signal is arranged and is output in accordance with a desired fundamental cycle, so that an output voice signal having the altered pitch is obtained while the formant of the voice signal input is maintained. The extraction width is set, for example, to twice of the fundamental cycle of the voice signal input.

To extract the input voice signal, the signal is temporarily stored in a memory and a predetermined extraction range is read therefrom. If the reading speed is higher than the writing speed, the waveform can be compressed. As a result, the formant is shifted to a high tone range, and the voice signal input, which has the sound quality of a male voice, can be changed so it has the sound quality of a female voice. The sound quality of the voice signal when originally input can be that of a female voice, and in this case, the formant is shifted to a higher tone range, so that the sound quality is regarded as having been changed to a female voice. When the reading speed is lower than the writing speed, the waveform can be extended when the voice signal is extracted. As a result, the formant will be shifted to a lower tone range, and the sound quality, which is representative of a female voice, can be changed to that of a male voice.

FIG. 5 is a second diagram for explaining another example processing performed by the formant modifier device 7 and the pitch shifter device 8 in FIG. 1. In this example, the cycle of an voice signal when it is output is shorter than the cycle that corresponds to the extraction width, including a case wherein the cycle of the voice signal that is output is shorter than the fundamental cycle of the input voice signal.

In FIG. 5(*a*) is shown a voice signal output as the first channel (Fader0), which is the same as the voice signal output in FIG. 4(*d*); and in FIG. 5(*b*) is shown a voice signal that is extracted with a delay equivalent to the desired fundamental cycle of the voice signal that is output and is multiplied by the window function. This signal is defined as an output tone signal of the second channel (Fader1). When the first and the second channels are combined, a voice signal output with the altered pitch can be obtained while maintaining the formant.

In FIG. 5, as in FIG. 4, if the waveform is compressed when the voice signal input is extracted, the formant is shifted to a high tone range, so that the sound quality of the voice signal is changed to that of a female voice. If the waveform is extended, the formant is shifted to a low tone range, so that the sound quality of the voice signal is changed to that of a male voice.

In FIG. 12 illustrating parameters, which will be described later, a parameter for a lead voice signal is listed. "Lead gender type" is a parameter for changing the sound quality, as described above. When the lead gender type is "off" or "unis(on)," the formant is not changed. When the lead gender type is "male," the formant is shifted to a low tone range, and when the lead gender type is "fem(ale)," the formant is changed to a high tone range. It should be noted that the sound quality of "unis(on)" can be changed by a parameter, "lead gender depth," that will be described later.

Further, the pitch detector 6 can analyze the formant of the input voice to detect the sound quality of the voice. Whether the formant of the input voice should be changed to high or low or remain unchanged is also determined, so that the sound quality matches that set by using the operation panel 5. As a result, the sound quality can be set to the quality designated.

The sound quality is not limited to the three levels of the male voice, female voice and neutral voice. More levels can be used for the formant change. In FIG. 12, while three formant levels are employed, the intensity for the application of the gender effect is determined at multiple levels in accordance with the "lead gender depth." For example, an extremely low voice or an extremely high voice can be set. Further, when the peak level of the formant differs, or the positions of a plurality of formant peaks are changed individually, such changes can provide a greater variety of sound qualities.

Parameter "lead pitch correction" in FIG. 12 is used to determine whether the pitch of a voice signal that has been input should be corrected to the nearest chromatic tone (a predetermined pitch tone determined by the pitch of a scale), or should be unchanged (free). By employing the pitch correction, the interval of an input voice signal that is deviated slightly can be changed to a correct interval. It should be noted that the parameter, "lead pitch correction," cannot be set in the "off" state of the "lead gender type" or in the detune harmony mode.

The parameter "Lead/harmonic balance" is for determining a volume balance between a lead voice signal (L), corresponding to the voice that is input, and a harmonic voice signal (H). "Lead vibrato," "lead vibrato depth" and "lead vibrato delay" are parameters for respectively determining a vibrato speed (Hz), a vibrato depth (cent), and a delay time (sec) required for a lead voice signal before a vibrato is begun. The vibrato for a lead voice signal is actually controlled in accordance with values obtained by multiplying the values of the "lead vibrato rate," the "lead vibrato depth" and the "lead vibrato delay" by 1/127 of the "vibrato rate," the "vibrato depth" and "vibrato delay" in FIG. 12.

A harmonic voice will now be described. In FIG. 1, a maximum of three voices are released for a harmonic voice. In the following example, however, the maximum number of voices for harmonic voices are defined as two, and in case of providing a gender effect for a lead voice, the maximum is defined as one.

FIG. 6 is a diagram for explaining the harmonic modes. A "vocoder harmonic mode," a "chordal harmonic mode," a "detune harmonic mode," and a "chromatic harmonic mode" are prepared, and each harmonic mode is sorted to one or more harmonic types.

FIG. 7 is a diagram explaining the types of the vocoder harmonic mode. The vocoder harmonic mode is a mode in which, when the keyboard is played while voice is entered, a harmonic voice is generated using the sound quality of the input voice and having a pitch comparable to that specified by the keyboard. In accordance with the harmonic type, the harmonic voice to be generated is shifted an octave away from the pitch of the harmony part, or is shifted (is automatically transposed) within a one-octave range wherein the pitch of the voice is in the center range.

FIG. 8 is a diagram for explaining the types of the detune harmonic mode. A detune harmonic mode is a mode in which the pitch of input voice is shifted slightly, and the obtained voice is released in order to provide a chorus effect. Since the pitch of the harmonic voice is determined in accordance with the detuning value and the input voice, it does not affect the scale of a harmony part, such as the scale of the keyboard. Although only one type is shown, a plurality of types can be set by changing the detuning value.

FIG. 9 is a diagram for explaining the types of the chromatic harmonic mode. A chromatic harmonic mode is a mode in which a harmonic voice is released that is shifted a fixed pitch away from that of the input voice. Since the scale of the harmonic voice is determined in accordance with the pitch shift distance and the input voice, it does not affect the pitch of the harmony part. The pitch shift distance is varied by changing the type.

FIG. 10 is a diagram for explaining the types of chordal harmonic modes. A chordal harmonic mode is a mode in which, for example, a chord entered by a keyboard is identified, and a harmonic voice consonant with the chord is generated. Merely by entering a voice, a harmonic voice consonant having a designated chord can be generated. The types for providing various harmonic voices that match jazz or blues can be selected by changing the harmonic types. Further, a voice 1 or voice 2 can be selected, or a harmonic voice having a high pitch (voice 1 is high) or a low pitch (voice 1 is low) can be designated relative to the pitch of the input voice.

It should be noted that "voice 1 is bass" means that the root tone of a designated chord is defined as the pitch of a harmonic voice. A "unison" is selected from among a harmonic voice having a pitch that corresponds to the pitch of the input voice, and harmonic voices having pitches that are higher or lower than that pitch by one to several octaves. When the gender type of the lead voice is not "off," the harmonic voice 2 is not released.

Instead of the keyboard play part, the automatic play part or the part assigned to an external device may be designated to the harmony part. For example, when a stored song is selected and a chord change is present in this song, the pertinent chord is entered so that a harmonic consonant with the progress of the music can be provided.

Thirty-seven chord types that are specified in the MIDI standards can be identified, and the pitch of the harmonic voice can be determined in accordance with the chord type and the pitch of the input voice (vocal note). In addition, since it is desired that the pitch of the harmony may vary in accordance with the harmonic type, there is no conversion formula that can be applied for any harmonic voice pitch. In this embodiment, therefore, the harmonic type, the chord type and the pitch of the input voice are detected and entered, and under these three conditions a conversion table is examined in order to determine the pitch of at least one type of harmonic voice.

Alternatively, the conversion table that is prepared for each harmonic type is selected in accordance with the harmonic type and is examined, while the pitch of the input voice and the chord type are employed as the condition entries, so as to determine the pitch of the harmonic voice. A set of such conversion tables is stored in a ROM (Read Only Memory) or an external storage device, so that various harmonic types can be easily added later, or a part of the harmonic types can be easily deleted in advance in accordance with a product model.

In either case, since there are many combinations of the harmonic types, input signal pitches and designated chords, it is difficult to calculate the pitch of an output signal having an altered pitch according to the conversion rule. However, when the conversion table is employed, the pitches of a variety of harmonic voices can be determined by using only a simple structure.

FIG. 11 is a diagram for explaining example contents of a pitch conversion table used in the chordal harmonic mode. In FIG. 11(*a*) is shown a conversion table for a chord type "Major" for a harmonic type "duet below". In FIG. 11(*b*) are shown chord types "Major" and "minor" for a harmonic type "jazz above & below."

In the conversion table, the pitch name of the harmonic voice signal, and data that represent an octave that is transposed from the octave for the pitch name (vocal note) of the input voice, are stored for each pitch name (C to B) ("lead voice name" in FIG. 11) for one octave of the vocal note of the input voice and is used as a reference. A to G entered in the columns for voice 1 and voice 2, which represent the harmonic voices, are pitch names for one octave; a 0 on the right indicates that it falls within the octave of the input voice; value −1 indicates the pitch name of an octave that is lower by one octave than the input voice; and value 1 indicates the pitch name of an octave that is higher by one octave than the input voice.

In the above explanation, the conversion table is examined by using, as a reference, the vocal notes of the input voice. However, while the gender of the lead voice is controlled, the pitch of the input voice may be changed and the lead voice signal may be generated. In this case, the conversion table is examined by using the pitch of the lead voice signal as a reference, and the pitch of the harmonic voice in the chordal mode is determined. Here, the vocal note of the input voice may also be used as a reference to examine the conversation table.

The same method is applied for the pitch that is used as a reference in the previously mentioned vocoder mode for the automatic transposition, and in the detune mode and the chromatic mode. That is, for the above described harmonic types, while taking into account the fact that the pitch of the input voice is changed during the gender control and a lead voice signal is generated, a harmonic voice can be produced by using the pitch of the lead voice signal as a reference.

In the above description, the harmonic voice in the chordal harmonic mode is added relative to the pitch of the input voice; however, another type of harmonic voices can be generated. That is, when the play data are input to the part that is allocated as the melody channel, the conversation table in the chordal harmonic mode is examined as is done for the pitch of the play data of the melody channel, or the pitch that is changed under the gender control (the conversion table is examined by replacing the pitch of the input voice with the pitch of the melody channel), so that the harmonic voice signal can be produced.

FIG. 12 is a diagram for explaining parameters that are used by the voice signal/tone signal processing apparatus in FIG. 1. Since the parameters for a lead voice have been explained, mainly the parameters for a harmonic voice will be explained. The "Harmonic gender type" is a parameter for determining the sound quality of a harmonic voice. When the parameter "harmonic gender type" is "off," the same sound quality is set as is set for the input voice, and when the parameter "harmonic gender type" is "auto," the sound quality of a harmonic voice is automatically changed in accordance with the following parameter. The "Auto upper gender threshold" is used to determine the number of semi-tones by which a harmonic voice must exceed the input voice in order to start the harmonic gender control. The opposite parameter "auto lower gender threshold" is used to determine the number of semi-tones by which a harmonic voice falls below the input voice in order to start the harmonic gender control. When the melody channel is designated and play data are entered for the part that is assigned as the melody channel, the sound quality is automatically changed, while rather than the pitch of the input voice, the pitch of the play data for the melody channel is used as the reference pitch.

The "Upper gender depth" is used to set the degree of conversion of a harmonic voice that exceeds the "auto upper gender threshold" to produce a female voice (although it sounds unnatural, this harmonic voice can be converted to produce a male voice in order to provide special sound effects). The "lower gender depth" is used to set the degree of conversion of a harmonic voice that exceeds the "auto lower gender threshold" to produce a male voice (although it sounds unnatural, this harmonic voice can be converted to produce a female sound). As the value rises, the resultant tone increasingly resembles a female voice, and as the value descends, the resultant tone increasingly resembles a male voice.

The "Harmonic vibrato rate," "harmonic vibrato depth" and "harmonic vibrato delay" are parameters for determining, for a harmonic voice, the speed (Hz) of vibrato, the depth (cent) of vibrato and the delay time (sec) required before the vibrato starts. The vibrato of the harmonic voice is actually controlled in accordance with a value obtained by multiplying these parameter values by 1/127.

The "Detune modulation" is a parameter for determining all the harmonic voices. "Harmonic1 detune" and "harmonic2 detune" are employed for voice 1 and voice 2 for each harmonic voice, and the actual detuning value for each harmonic voice is determined by multiplying the two parameter values by 1/127. The "Harmonic1 volume" and "harmonic2 volume" are parameters for determining the volume of each harmonic voice. The actual volume is determined by multiplying the parameter values by "lead/harmonic valance." The "Harmonic1 pan" and "harmonic2 pan" are used to determine the localization of each harmonic voice. R denotes the right localization, and L denotes the left localization. The "Harmony part" is effective when the "harmonic mode" is the vocoder harmonic mode, and is used to determine the part of a keyboard that controls the harmonic voice. The "upper" is used to determine the addition of a harmonic to the keyboard play performed on the right region of a split point of the keyboard, and the "lower" is used to determine the addition of a harmonic to the keyboard play performed on the left region.

The "Pitch-to-note switch" is used to designate the generation, at the pitch of the input voice, of a musical tone that has the timbre of a part (R1, R2 or Left) of the keyboard that is designated by the parameter "pitch-to-note part." The "Harmonic additional reverberation depth" and "harmonic additional chorus depth" are used to determine the depth of the reverberation effect and chorus effect that are provided exclusively for a harmonic voice. The "Variation parameter" is provided for each kit that has an extended harmonic mode and will be described later. When the variation switch is turned on, the value of the "variation parameter" is temporarily changed. This temporary parameter value is determined by the parameter "variation value."

As described above, not only are many parameters provided, but also, these parameters are mutually related. Thus, it is almost impossible for a user to use the operation panel 5 to set the individual parameter values. Thus, a vocal harmony is sorted to a plurality of characterizing types (consisting of lead voices and harmonic voices). When the operation panel 5 is used to designate a harmonic type, the vocal harmony type that is preset in the ROM, and almost all the parameters that are related to the lead voice signal and the harmonic voice signal are collectively set to specific values that are appropriate for the designated type. The group of parameters that are collectively designated is defined as a harmony kit (hereinafter referred to simply as a kit).

When the stored kit is selected, that kit is read and parameters are selectively set, so that a voice signal that has been input can be processed, and a harmony having various complicated pitches and sound effects can be easily output. A female voice duet, a mixed chorus, country music, jazz, a cappella, etc., are prepared as kits, and unique vocal tones can be collectively set for them. Since a conventional chordal harmonic merely follows a designated chord, only a common harmonic is added, and characteristic music performance, such as country music or jazz, cannot be coped with. However, by using the above described kits, a variety of setups can be easily obtained.

FIG. 13 is a first diagram for explaining harmony kits, and FIG. 14 is a second diagram for explaining harmony kits. In the lists of example kits, 49 types are shown, and for each kit, a name that describes the characteristic of the type is provided. Example parameters that are set by selecting a kit are those shown in FIG. 12. It should be noted, however, that only one part of the parameter values are shown in FIGS. 13 and 14. Further, a case wherein a harmony kit is not selected is provided as one of the types.

For a kit, the number of harmonies and the localization can also be selected by designating the harmonic type. Multiple parameters concerning gender control are also included, as well as parameters concerning the production of sound effects for a lead voice signal and a harmonic voice signal, and parameters concerning volume and volume balance. The parameters registered as a harmony kit are not always fixed values, and the operation panel 5 can be used to change or slightly adjust the values of part of the parameters.

In FIGS. 13 and 14, there are multiple kits having the kit names that are associated with gender. In most of these kits, the harmonic gender type is set to "Auto." In the kits for which "Auto" is set, although not shown, the "upper gender depth" is set to a value for a female-like voice, and the "lower gender depth" is set to a value for a male-like voice. Therefore, when the pitch of the harmonic voice is higher than the reference pitch (the pitch of the input voice or the pitch of the melody channel) and the pitch exceeds the predetermined "auto upper gender threshold" (frequently 0), the sound quality is near that of a female voice. When the pitch of the harmonic voice is lower than the pitch of the input voice and falls below the predetermined "auto lower gender threshold" (frequently 0), the sound quality is near that of a male voice.

When a kit that represents a female voice is selected on the operation panel 5 in FIG. 1, the pitch of the harmonic voice for which the formant has been converted to produce a female voice is actually higher than the pitch of the input voice. When a kit that represents a male voice is selected, the pitch of the harmonic voice for which the formant has been converted to produce a male voice is actually lower than the pitch of the input voice. When a kit that represents a mixed chorus is selected, the pitch of the harmonic voice for which the formant has been converted to produce female voices is actually higher than the pitch of the input voice, and the pitch of the harmonic voice for which the formant has been converted to produce male voices is actually lower than the pitch of the input voice.

Especially in the chordal harmonic mode, "Auto" is set for all the kits having a kit name that is associated with a female voice or a mixed chorus, and "Above" is designated for voice 1 by the "harmonic type" parameter. Therefore, a harmonic voice having a pitch higher than the input voice is always set. Further, "Auto" is set for most of the kits having a kit name that is associated with a male voice or a mixed chorus, and "Below" or "Bass" is designated for voice 1 by the "harmonic type" parameter. Therefore, a harmonic voice having a pitch lower than the input voice is always set.

For a kit that has a kit name associated with a male voice or a mixed chorus and for which "Auto" is not set, a harmonic voice is generated without changing the formant of voice that is input.

As previously described, an arbitrary "variation parameter" can be set for each kit, and when the variation switch is turned on, the parameter value can be changed to a designated value. If, as a variation parameter, a parameter concerning sound quality is changed, a remarkable variation can be added as a sound effect for a vocal tone.

For example, "Auto" is set for a kit for which the "harmonic gender type" setting is "Off." Otherwise, for a kit in which the setting for the "harmonic gender type" is "Auto," the "upper gender depth" or the "lower gender depth" is set to reflect an extreme value in the same direction (toward the same sound quality), or in the reverse direction (away from the sound quality). Similarly for a lead voice, the designation (off, a male voice, a female voice or a neutral voice) for the "lead gender type" is mutually changed, or the value of the "lead gender depth" is changed to reflect an extreme value.

When one of the above described kits is selected, parameters concerning the vocal harmony (the lead voice signal and a plurality of harmonic voice signal types) can be collectively designated. Not only the number of types (voices) of harmonic voice signals, but also pitches and sound qualities above or below those of the Input voice can be set. In addition, sound effects, such as reverberation or vibrato, can be applied to vocal harmonies (the lead voice signal and the harmonic voice signal), separately from a music tone signal.

The addition of reverberation and other sound effects can be selected simply by using buttons on the operation panel, which will be described later. As is described above, since the input voice and a musical tone can be easily handled separately, switching in match with music performance can be easily obtained. Parameters for collectively setting sound effects for the musical tone signal, the lead voice signal and the harmonic voice signal may be included in a kit, or may be designated by using the buttons on the operation panel.

Figure 15:
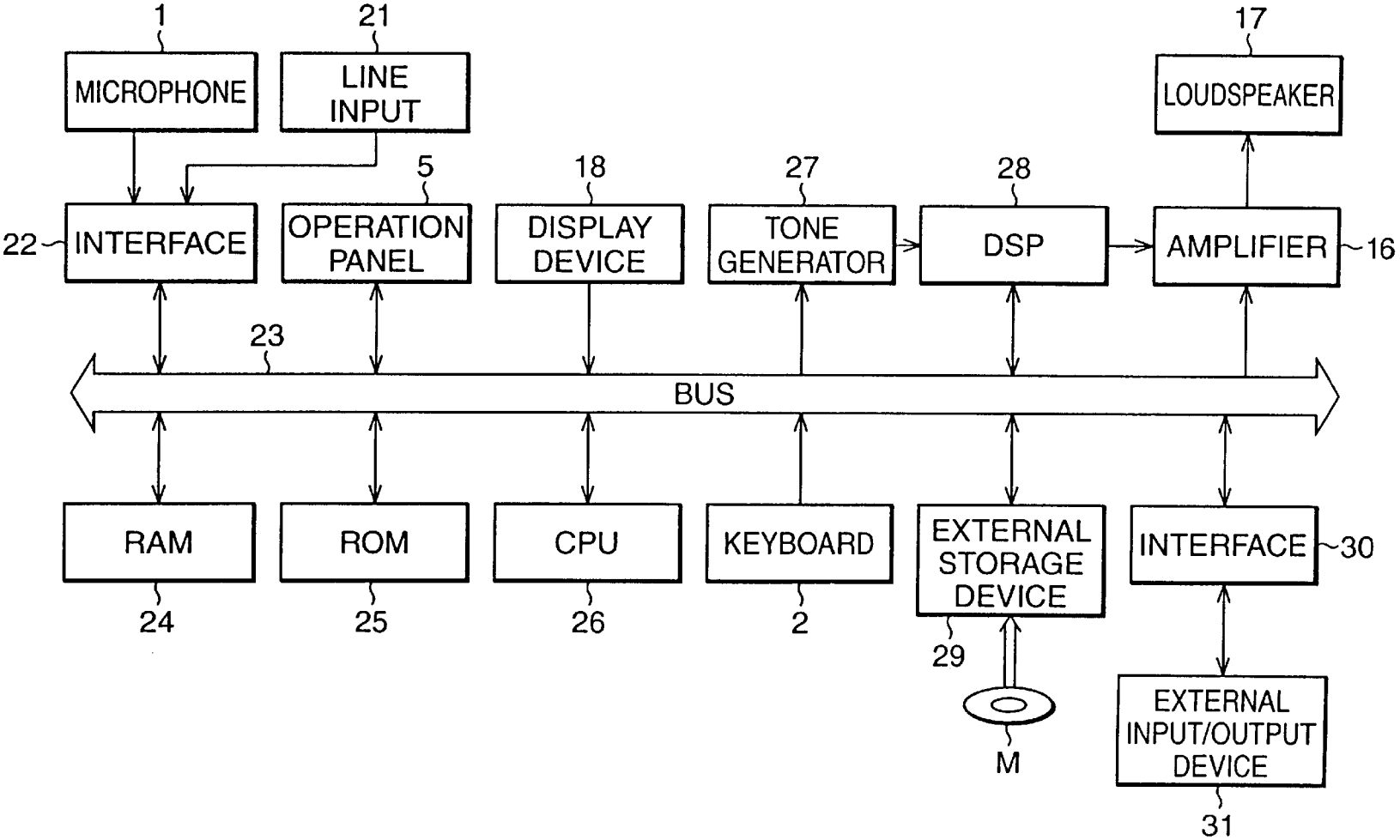
FIG. 15 is a diagram illustrating hardware arrangement of the voice signal/tone signal processing apparatus of FIG. 1 according to the embodiment of the present invention.

FIG. 15 is a diagram, according to the embodiment of the present invention, illustrating the hardware arrangement of the voice signal/tone signal processing apparatus in FIG. 1. The same reference numerals as in FIG. 1 are used to denote corresponding components, and no further explanation for them will be given. Reference numeral 21 denotes a line input unit; 22, an interface; 23, a CPU bus; 24. RAM; 25, ROM; 26, a CPU; 27, a tone generator; 28, a DSP; 29, an external storage device; 30, an interface; and 31, an external input/output unit.

A/D conversion is performed, via the analog input interface 22, for an input voice received through a microphone 1 and a line input unit such as a CD player and a tape cassette player, and the results are transmitted to the CPU bus. A plurality of hardware units, such as the RAM 24, the ROM 25 and the CPU 26, are connected to the CPU bus 23, and a display device 18 displays a setup menu for harmony kits and individual parameters. In the ROM 25 is stored the voice signal/tone signal processing program of the present invention that is executed by the CPU 26, as well as waveform data, preset data such as kits, a parameter conversion table, and demonstration song data for automatic playing. In the RAM 24 are prepared a working area required for the execution of processes by the CPU 26, and a buffer area for parameter editing.

A ROM cartridge or a flexible magnetic disk (FD) is employed as a recording medium for the external storage device 29, which can also serve as a storage unit of the automatic player 3 in FIG. 1. Timbre data and song data are stored on the recording medium, and data that are not stored in the ROM 25 can be added. Further, song data can be recorded or reproduced by a recording/reproduction apparatus. The interface 30 includes a MIDI input/output terminal or an RS232C terminal, and exchanges MIDI data with the external input/output device 31, which may be a MIDI device such as a MIDI keyboard sequencer, a special tone generator, or a personal computer.

The tone generator 27, which does not always correspond to the functional block of the tone generator 12 in FIG. 1, receives a tone parameter from the CPU 23 and generates a musical tone signal. The DSP 28, which is controlled by the CPU 26, performs formant alteration, pitch detection and pitch conversion for a voice signal entered at the microphone 1 or a tone signal input along the line input 21, and provides a sound effect such as reverberation or chorus, for the voice signal or the tone signal. At least a part of the functions of the tone generator 27 and the DSP 28 may be implemented by software that is executed by the CPU 26. The functions of the above described DSP 28 may be distributed so that different DSPs are employed for pitch detection and pitch conversion for a signal of the input voice, and for the application of a sound effect of an output signal. The signal output by the DSP 28 is converted into an analog signal by a D/A converter (not shown), and the analog signal passes through the amplifier 16 and is released as a sound signal through the loudspeaker 17.

The CPU 26 employs the RAM 24 or the ROM 25 to process a voice signal entered at the microphone 1, operation data entered at a keyboard 2 or at an operation panel 5, and play data received from the external storage device 29 or the external input/output device 31; displays various setup menu screens on the display device 18; controls the tone generator 27, the DSP 28 and the amplifier 16 based on the processed play data; and outputs MIDI data externally via the interface 30. The play data can be stored as sequence data, which includes time interval data, in the external storage device 29, or in the external input/output device 31.

The voice signal/tone signal processing apparatus of this invention can be implemented by the special hardware configuration in FIG. 15. This apparatus can be implemented by a general-purpose personal computer wherein a digital/analog converter (DAC) is mounted and a codec driver is installed, and wherein the voice signal/tone signal processing program is executed by a CPU and an operating system (OS). The voice signal/tone signal processing program is supplied along a communication line, or on a recording medium M, such as a CD-ROM, and is installed on a magnetic hard disk.

This recording medium M is stored with a voice signal/tone signal processing program for treating as an input signal a voice signal or a musical tone signal, and for processing the input signal to generate at least one type of output signal. The following recording medium M is employed.

First, the recording medium M is stored with a voice signal/tone signal processing program that permits a computer to function as: a reference pitch designation section; and an output signal generation section, which receives an input signal, a timber change designation signal and a reference pitch designated by the reference pitch designation section, and while changing the timbre of the input signal in accordance with the timbre change designation signal, changes the pitch of the input signal, so the pitch is made higher or lower than the reference pitch in accordance with the timbre change designation signal, and generates an output signal.

Second, the recording medium M is one on which is stored a voice signal/tone signal processing program that permits a computer to function as: a pitch detection section, which detects the pitch of the input signal; and an output signal generation section, which receives an input signal, a timber change designation signal and the pitch of the input signal detected by the pitch detection section, and while changing the timbre of the input signal in accordance with the timbre change designation signal, raises or lowers the pitch of the input signal in accordance with the timbre change designation signal, and generates an output signal.

Third, the recording medium M is one on which is stored a voice signal/tone signal processing program that permits a computer to function as: a pitch determination section, which determines the pitch of the output signal by referring to the pitch conversion table; an the output signal generation section, which, to generate an output signal, receives an input signal and changes the pitch of the input signal so the pitch equals the pitch of the output signal determined by the pitch determination section.

Fourth, the recording medium M is one on which is stored a voice signal/tone signal processing program that permits a computer to function as: a parameter output section, which stores a plurality of parameter kits, each of which is comprised of a plurality of parameters that include, at least, a parameter for controlling the pitch of an output signal and that characterize the output signal, and which receives a kit designation signal and refers to the parameter kit to output, at least, a parameter for controlling the pitch of the output signal; and an output signal generation section, which receives the input signal and changes the pitch of the input signal in accordance with, at least, the parameter output by the parameter output section and which generates an output signal.

Fifth, the recording medium M is one on which is stored a voice signal/tone signal processing program that permits a computer to function as: an effect setting section, which sets a parameter concerning one or more sound effects to be applied to an output signal for a voice signal/tone signal processing apparatus that employs a voice signal or a tone signal as an input signal and that processes the input signal to generate at least one type of output signal; an effect instruction section for instructing the application of at least one of the sound effects to be provided; and an effect applying section for setting the sound effect based on the parameter that is set by the effect setting section and that is related to the sound effect.

Figure 16:
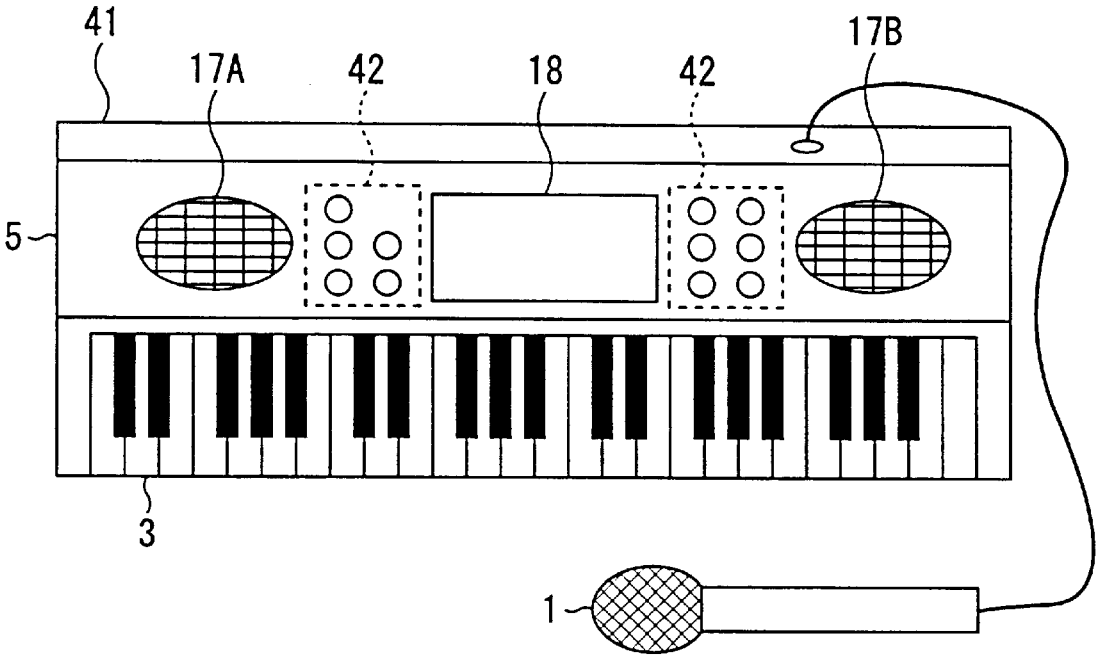
FIG. 16 is a diagram illustrating a n external appearance of the voice signal/tone signal processing apparatus of FIG. 1.

FIG. 16 is a diagram showing the external appearance of the voice signal/tone signal processing apparatus in FIG. 1 according to the embodiment of the present invention. The same reference numerals as in FIGS. 1 and 15 are used to denote corresponding components, and no further explanation will be given for them. Reference numeral 41 denotes the main body of an electronic musical instrument; 42, an operator group; 17A, a left loudspeaker; and 17B, a right loudspeaker.

The main body 41 of the electronic musical instrument includes the keyboard 3 and the loudspeakers 17A and 17B. The operator group 42, which is comprised of a plurality of operators, and the display device are provided on the operation panel 5. The keyboard and the operators are conceptually shown, and specific shapes and numbers are not illustrated. Switches that are closely related to the present invention are an ON/OFF switch used to designate the output of vocal harmony (a lead voice signal and a harmonic voice signal); an ON/OFF switch used to designate the application of reverberation for the vocal harmony; and an ON/OFF switch used to designate the application of a sound effect other than the reverberation for the vocal harmony. In addition, there are an ON/OFF switch for designating the application of a sound effect for a musical tone signal; a vocal harmony switch for designating a vocal harmony; a "BACK" switch for changing a setup menu; a "NEXT" switch; and a "+" switch and a "−" switch for selecting parameters.

Although not shown, the main body 41 of the electronic musical instrument includes a ROM cartridge, an FD insertion slot, a MIDI terminal and an RS232C terminal. A pitch bend wheel and a modulation wheel may also be provided.

The pan controller 15 in FIG. 1, which determines the localization of a sound image, controls the volume ratio of voices and musical tones that are output through the left loudspeaker 17A and the right loudspeaker 17B, so as to adjust the individual localized positions of input vocal tones, harmonic voices and musical tones. The pan control is also provided as one of the sound effects. Conventionally, random pan for randomly localizing musical tone signals is performed as one type of acoustic effect. For example, while a user depresses a key, a musical tone signals are released in every direction, from the right and then from the left. A parameter may be included for applying this random pan individually to voice signals or to musical tone signals.

FIGS. 17 to 20 are flowcharts showing the processing steps according to the embodiment of the present invention for explaining the operation performed by the voice signal/tone signal processing apparatus.

Figure 17:
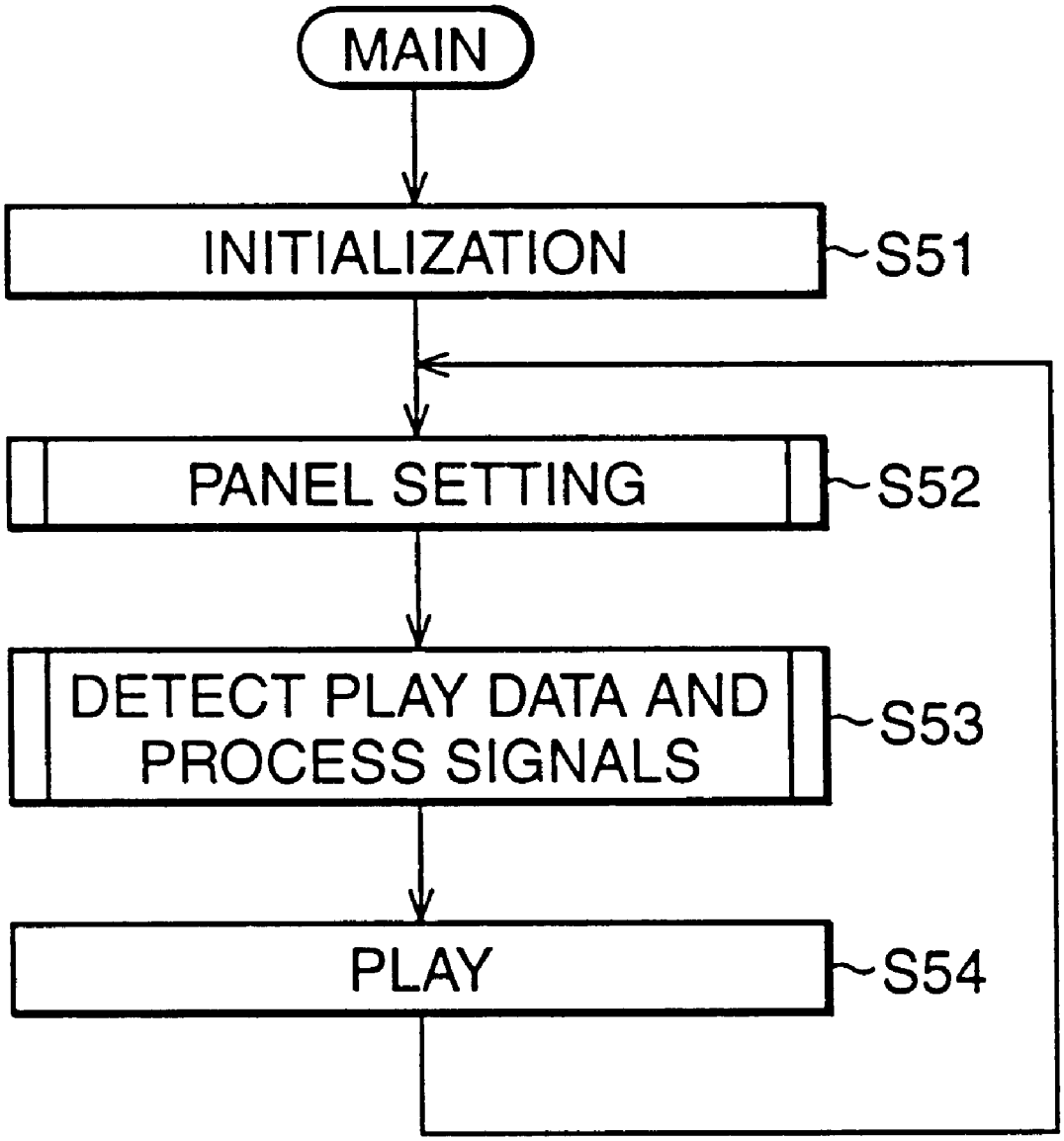
FIG. 17 is a flowchart showing main processing and interrupt processing.

FIG. 17 is a flowchart of a main process and an interrupt process. At step S51, the apparatus is initialized, and at step S52, the operator group 42 is employed to input various control entries and to set various parameters, while switching the screen of the display device 18. This step will be described later, while referring to FIGS. 18 and 19. At step S53, play data are detected, and a voice signal or a tone signal is processed. This step will be described later, while referring to FIG. 20.

At step S54, based on the various control entries and the parameters that are set, a lead voice, a harmonic voice and a musical tone are released. That is, based on play data corresponding to the depression of a key at the keyboard 2, the automatic play data received from the external storage device 29, MIDI data entered by the external input unit 4, or the voice signal or the tone signal entered by the line input unit 21, those of a lead voice signal, a harmonic voice signal and a musical tone signal are generated in accordance with a control mode and parameters that are selected at the operation panel 5, and these signals are transmitted to the amplifier 16.

For a vocal tone signal that is formed of a lead voice signal and a harmonic voice signal, the play data entered at the keyboard can be employed to change not only an original voice signal that is input, but also the timbre of the voice. Specifically, the gender of the sound quality can be changed (from a female voice to a male voice, from a male voice to a female voice, etc.), or the pitch can be altered. When the process at S54 is terminated, program control returns to S52, and the processes at steps S52 through S54 are repeated.

Figure 18:
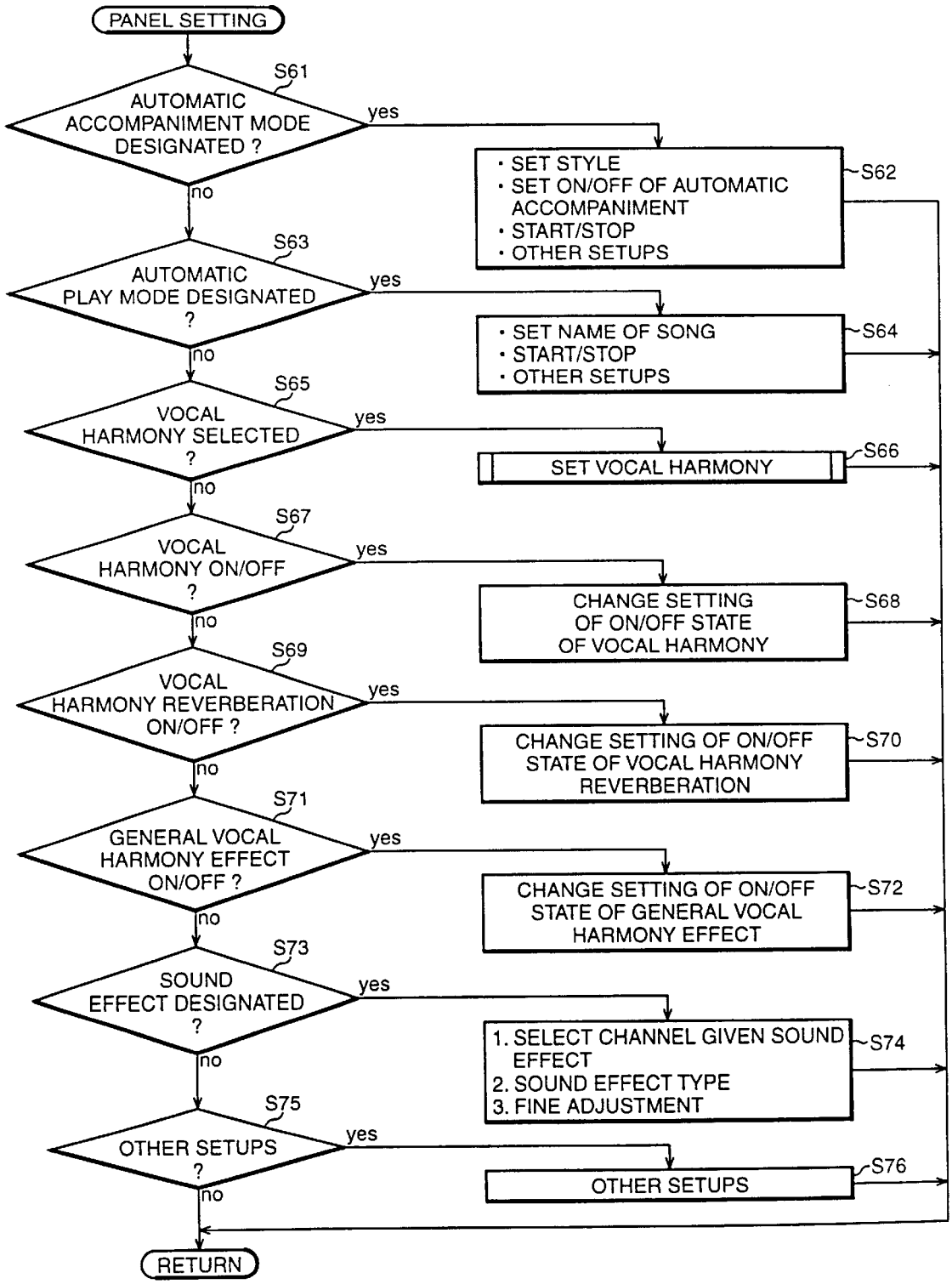
FIG. 18 is a flowchart showing panel setting process of FIG. 17.

FIG. 18 is a flowchart showing the panel setting process in FIG. 17. At S61, a check is performed to determine whether an automatic accompaniment mode has been selected (setup is changed or execution is instructed) using the operation panel 5. If the automatic accompaniment mode has been selected, program control advances to S62. If the automatic accompaniment mode has not been selected, program control is shifted to S63. At S62, in accordance with the selection, the automatic accompaniment style, the ON/OFF state of the automatic accompaniment and the start/stop of the automatic accompaniment are designated in addition to other setups. Thereafter, program control returns to the main flowchart in FIG. 17.

When the automatic accompaniment is played in the chordal harmonic mode, at the time when the automatic accompaniment begins for a musical tone, the pitch of a harmonic voice can be determined in accordance with a chord that is generated based on a chord entered at the keyboard and that is detected for the automatic accompaniment, and in accordance with the pitch of the input voice. The chord part for the automatic accompaniment need only be designated as a harmony part.

At step S63, a check is performed to determine whether the automatic play mode has been selected (the setup has been changed or the execution has been instructed) at the operation panel 5. If the automatic play mode has been selected, program control advances to S64. If the automatic play mode has not been selected, program control is shifted to S65. At step S64, in accordance with the selection, the name of a song recorded in the ROM 25 or the external storage device 29 in FIG. 15 is set, and the start/stop is designated, as well as other setups. Program control thereafter returns to the main flowchart in FIG. 17.

The harmonic mode selection data and the data indicating a specific track recording pitch data for controlling a harmonic voice can be written in a song. When these data are detected, the specific track can be designated as a harmony part. At the time of the automatic play of musical tones generated by the tone generator 27, the pitch of a harmonic voice can be automatically set.

Otherwise, when it is known that pitch data for controlling harmonic voices are recorded on a specific track for songs that are produced by a certain company, and it is determined that the copyright contained in the selected song identifies this company, the specific track can be designated as a harmony part. At the time when the automatic play of musical tones is begun, the pitch of a harmonic voice can be automatically set. For a song, a user can also perform a track re-designation in order to control the harmonic voice.

At step S65, a check is performed to determine whether the vocal harmony has been selected. When the vocal harmony has been selected, program control advances to S66. If the vocal harmony has not been selected, program control advances to S67. To change the various setups for the vocal harmony, the "vocal harmony" button is depressed.

Figure 19:
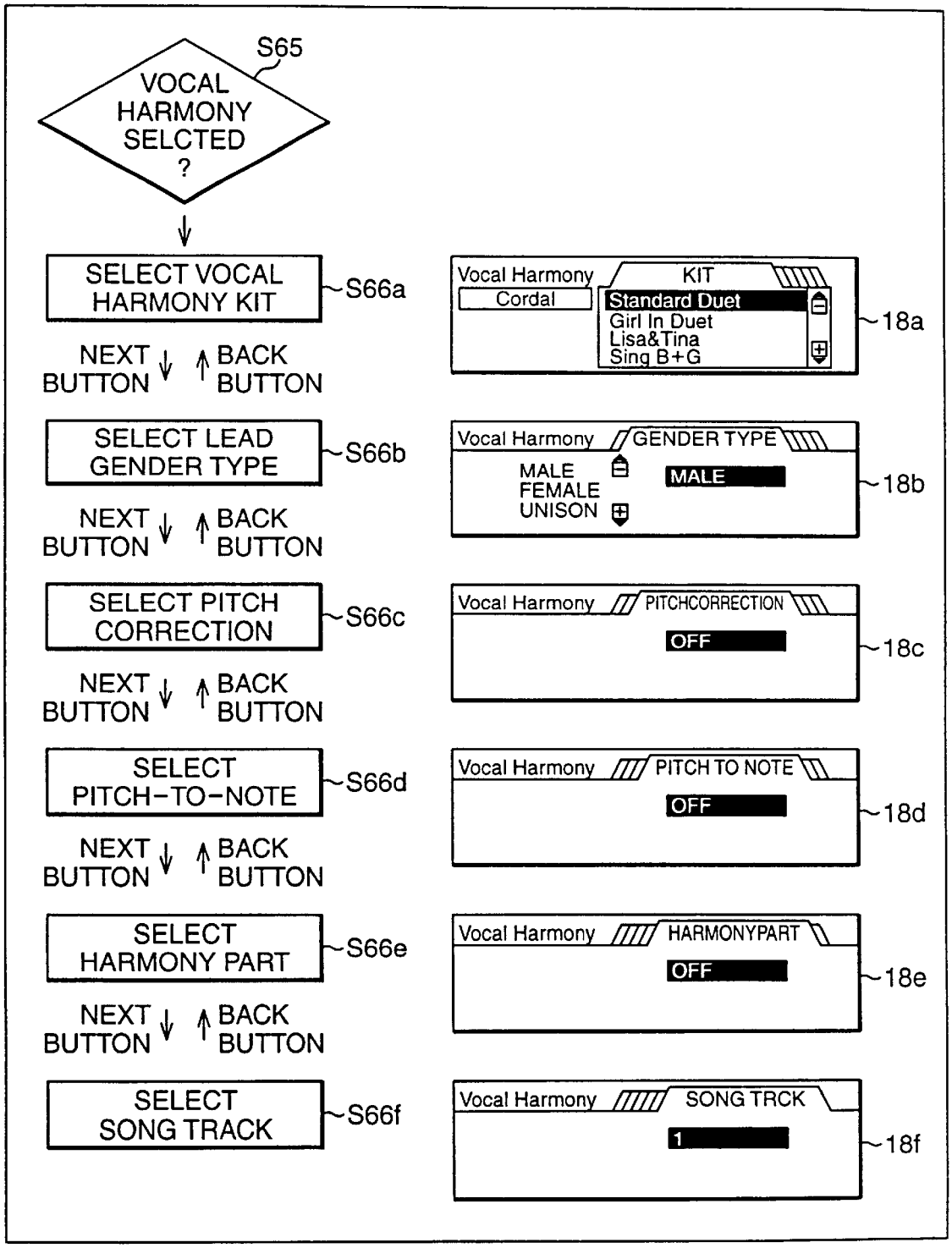
FIG. 19 is a flowchart showing process at step S66 of FIG. 18.

FIG. 19 is a flowchart showing the process at S66 in FIG. 18. Steps S66*a* to S66*f* are selectively changed by using the NEXT button and the BACK button, and in accordance with the steps designated, as is indicated by 18*a* to 18*f*, the display screen of the display device 18 is sequentially changed.

The steps in FIG. 19 are performed for setting a vocal harmony using the menu display screen. A vocal harmony is selected while the characteristic thereof is provided by various parameters. A menu setup screen using a tab-dialogue is shown as the display screen, and in the example, seven tabs are prepared. Since a mouse pointer is not employed, switches, such as the "NEXT" button and the "BACK" button, on the operation panel are employed to select tabs and setup entries. As needed, characters or pictures (not shown) to provide input guidance are displayed in a blank portion in the tab-dialogue box.

As previously described, there are multiple types of parameters, and it is difficult to set the parameters one by one. Thus, a plurality of parameters for a vocal harmony are preset and provided in the form of a kit.

At step S66*a*, a vocal harmony kit is selected. As is shown on the display screen 18*a*, the kit tab-dialogue box is displayed in the foreground. 49 types of harmony kits are prepared as shown in FIGS. 13 and 14. Since the display screen is small, a part of these types, i.e., four types, are displayed, and harmony kits on the display can be scrolled by using the "+" button and the "−" button, and a highlighted harmony kit can be sequentially changed. When the "NEXT" button or the "BACK" button is depressed, the highlighted "standard duet" is selected and entered, and the step is switched to the preceding or succeeding selection step.

At step S66*b* to S66*f*, a part of the parameters that are collectively set as a kit, or other parameters that cannot be set as a kit, is designated. At S66*a*, the display screen of the following setup menu is changed in accordance with a selected kit, and only selectable parameters are displayed, or the display highlighting is inhibited for parameters that cannot be selected.

At step S66*b*, the lead gender type is selected to change the sound quality of a lead voice (microphone entry). For example, the tones released are for a female voice, even though a man is singing. As is shown on the display screen 18*b*, the tab dialogue box for the gender type is displayed in the foreground. "MALE" indicates a male voice, "FEMALE" indicates a female voice, "UNISON" indicates the intermediate sound quality of the male voice "MALE" and the female voice "FEMALE," and "OFF" indicates there is no change of the sound quality. The sound quality can be changed by using the "+" button or the "−" button. When the "NEXT" button or the "BACK" button is depressed, the highlighted "MALE" (male voice) is selected and input as a parameter, and the step is switched to the preceding or succeeding selection step.

At step S66*c*, a check is performed to determine whether pitch correction, which is a function performed to correct an original interval (a lead voice) that has been deviated even slightly. On the display screen 18*c*, "ON" or "OFF" is selected by using the "+" button or the "−" button. It should be noted that "ON" is not displayed when the harmony kit of the detune harmonic mode (a mode that additionally provides a harmonic having an interval that is slightly shifted away from the pitch of the voice that is input) is selected at S66*a*, or when "OFF" is selected at S66*b*.

With the pressing of the "NEXT" button or the "BACK" button, the highlighted "OFF" is selected and entered as a parameter, and the step is switched to the preceding or succeeding selection step.

At step S66*d*, a check is performed to determine whether pitch-to-note is to be performed whereby the timbre of a musical instrument can be released at the pitch of the voice that is input. On the display screen 18*d*, "ON" or "OFF" is selected by using the "+" button or the "−" button. Otherwise, in order to designate a pitch shift distance as a parameter, the pitch shift distance is displayed for selection on the display screen 18*d*. When the pitch shift distance has been determined, a musical tone having a high pitch (e.g., the pitch is shifted one octave) can be released when a low voice is received. When the "NEXT" button or the "BACK" button is depressed, the highlighted "OFF" is selected and is entered as a parameter, and the step is switched to the preceding or succeeding step.

At step S66*e*, the harmony part is selected. Only when, at step S66*a*, a harmony kit that belongs to the "vocoder harmonic type" is selected as a vocal harmony kit, a setup other than "OFF" can be designated. As the "vocoder harmonic type," a harmonic voice is added to the pitch employed for the playing at the keyboard, using the sound quality of the voice, or the sound quality obtained by changing the gender of the voice that is input. The "harmony part" is a parameter for designating the part of the keyboard that determines the pitch of the harmony when the keyboard is played.

The value "OFF" on the display screen 18*e* is used to indicate that no harmonic is added to the keyboard play; "UPPER" is used to indicate the provision of a harmonic for the keyboard play on the right region of a split point of the keyboard; "LOWER" is used to indicate the provision of a harmonic for the keyboard play on the left region of the split point. These parameters are highlighted by using the "+" button or the "−" button. When the "NEXT" button or the "BACK" button is depressed, the highlighted "OFF" is selected and entered, and the step is switched to the preceding or succeeding selection step.

At step S66*f*, when a song is reproduced in the automatic play mode (song mode)and when a harmonic is added with the sound quality of the input voice or the sound quality obtained by changing the gender of the input voice, a particular track of the song is selected so that the play data recorded on the pertinent track are used to determine the pitch of the voice. On the display screen 18*f*, tracks "1" to "16" are highlighted by using the "+" button or the "−" button. When the "BACK" button is depressed, the highlighted track "1" is selected and entered as a parameter, and the step is switched to the preceding selection step S66*e*. In addition, when the "NEXT" button is depressed, the highlighted track "1" may be selected and entered as a parameter, and the step may be switched to the first selection step S66*a*.

At steps S66*b* through S66*f*, one of a plurality of values is selected on the setup menu. However, parameters may be edited using a method whereby numbered key buttons are used to enter the numerical values of the parameters and even fine adjustments in the values can be made, as desired by a user.

Further, not only may a system be employed for controlling the pitch of one or more harmonic voice signals based on a play signal received from one harmony part, but also a system may be employed for providing a plurality of harmony parts and for individually controlling the pitches of a plurality of harmonic voices, or a system may be employed for controlling the pitch of one or more harmonic voice signals based on a play signal that is obtained by mixing play signals received from a plurality of harmony parts.

An explanation will be given while again referring to FIG. 18. When the process at step S66 is terminated, program control returns to the main flowchart in FIG. 17. When, at step S65, the vocal harmony has not been selected, program control advances to step S67. At step S67, a check is performed to determine whether the vocal harmony is set to the ON state or the OFF state. When the vocal harmony is designated, program control advances to step S68. When the vocal harmony is not designated, program control advances to step S69.

At step S67, whether the "vocal harmony" button is depressed is examined to determine whether the ON/OFF state of the vocal harmony has been selected. When the "vocal harmony" button has been depressed, program control advances to step S68. If the "vocal harmony" button has not been depressed, program control advances to step S69. At step S68, each time the depression is detected, whether the vocal harmony (a lead voice signal and a harmonic voice signal) should be output is determined, and program control thereafter returns to the main flowchart in FIG. 17.

At step S69, whether the reverberation button for the vocal harmony (lead voice signal and harmonic voice signal) has been depressed is examined to determine whether the reverberation effect has been selected for the vocal harmony. When the reverberation button has been depressed, program control advances the process to step S70. When the reverberation button has not been depressed, program control advances the process to step S71. At step S70, each time the depression of the button is detected, whether the reverberation effect should be added to the vocal harmony is determined, and program control returns to the main flowchart in FIG. 17. The parameter related to the reverberation of the vocal harmony is either set at step S74, which will be described later, or is preset, and reverberation is added to a generated vocal harmony.

The reverberation effect is set independently of the reverberation that is to be added to a musical tone signal, so that the harmonic voice can be clearly distinguished from a musical tone. Further, since the ON/OFF state of the reverberation can be controlled by the depression of one button, the ON/OFF state of the effect can be easily set for a harmonic voice, independently of a musical tone. Therefore, it is not necessary for the setup screen to be opened each time so as to change the reverberation parameter to a desired value or zero. Further, for effects other than the reverberation, their ON/OFF states can also be controlled independently of the setup operation for the parameters.

At step S71, check is made to ascertain whether another effect button for vocal harmony (lead voice signal and harmonic voice signal) has been depressed in order to determine whether the ON/OFF state of an effect other than reverberation has been set for the vocal harmony. When another effect button for vocal harmony has been depressed, program control advances to step S72. When any other effect button has been depressed, program control advances to step S73. At step S72, each time the depression of the button is detected, the effect to be applied to the vocal harmony is determined, and program control returns to the main flowchart in FIG. 17. Sound effects other than the reverberation effect that is to be added to the vocal harmony is either set at step S74, which will be described later, or is preset.

At step S73, a check is performed to determine whether a sound effect has been set. If there is an entry for a sound effect, program control advances to step S74. If there no entry has been made for a sound effect, program control advances to step S75. At step S74, a sound effect to be added to the vocal harmony (a lead voice signal and a harmonic voice signal) and to other common musical tones is selected on the menu display screen (not shown). First, a part for setting the application of a sound effect is selected from among a plurality of parts shown in FIG. 2. As the harmony part, a harmonic voice higher than the input voice, a lower harmonic voice, and a lead voice corresponding to the input voice may be individually designated. The sound effects include reverberation, chorus, vibrato and random pan, and a gender effect (the sound quality type for a lead voice is set at step S66*b* in FIG. 19, as previously described) is provided for a vocal harmony. The parameters representing the magnitudes of the effects are also prepared as, for example, a harmony kit. In addition, for at least one part of the parameters, the setting can be changed greatly, or the parameter values can be slightly adjusted. When the process is terminated, program control returns to the main flowchart in FIG. 17.

At step S75, a check is performed to determine whether other setup has been entered. If other setup has been entered, program control advances to step S76. If no other setup has been entered, program control returns to the main flowchart in FIG. 17. At step S76, for each part, other setup such as the timbre of a musical instrument (a voice change), the volume, a pan or an octave shift, is designated, and setup concerning the execution of the automatic accompaniment or the automatic play is performed. Program control thereafter returns to the main flowchart in FIG. 17.

Figure 20:
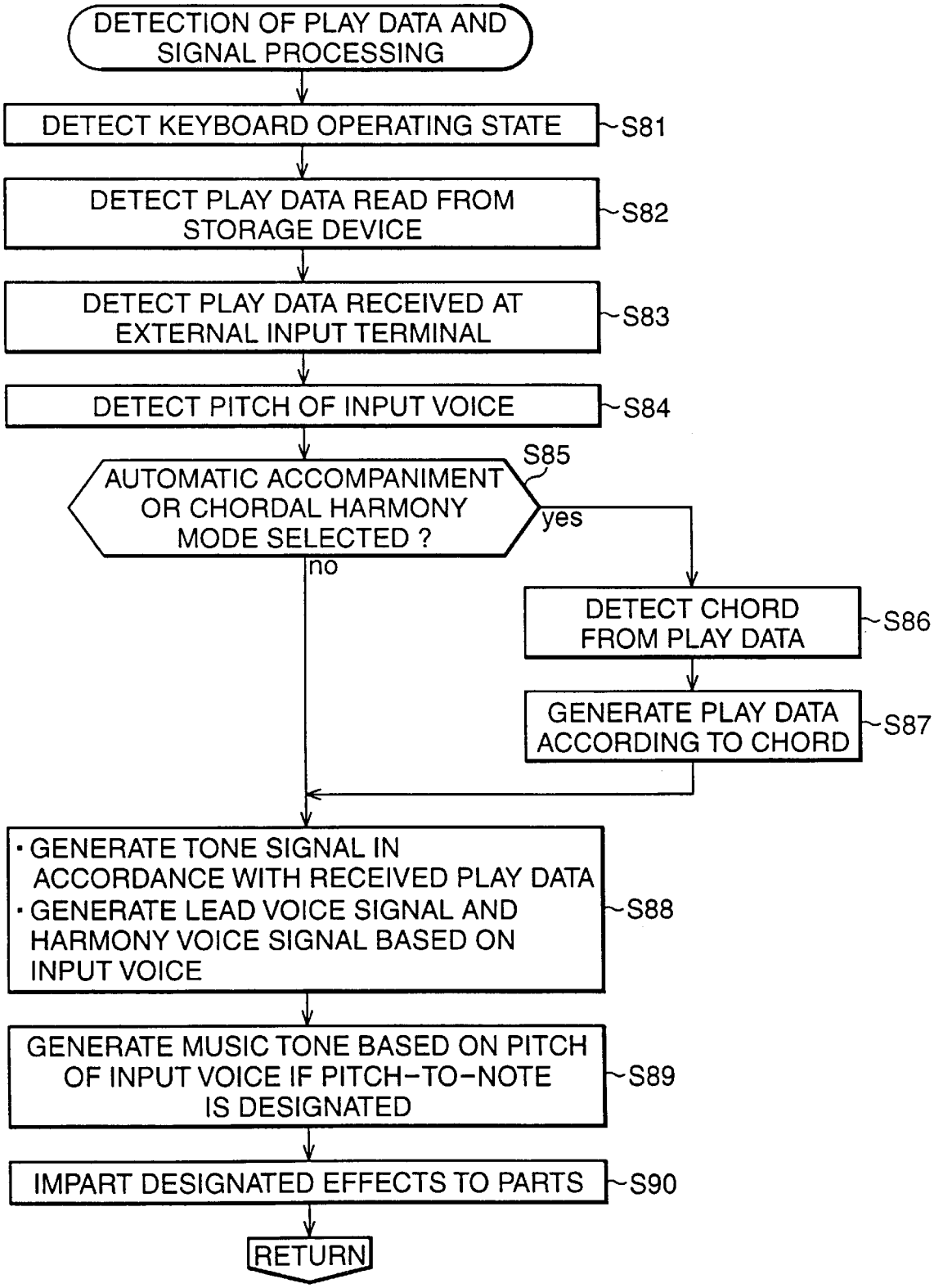
FIG. 20 is a flowchart showing process at step S53 of FIG. 18.

FIG. 20 is a flowchart showing the process at step S53 in FIG. 17. At step S81, a key depression signal generated while a user is playing the keyboard is detected, and program control advances to step S82. Normally, the key depression signal is used as play data to designate the pitch, and is released as a musical tone signal. At step S82, for example, the play data that are stored in the SMF (Standard MIDI File) form in the storage device are read and detected, and program control advances to step S83. That is, the play data are detected after the automatic play has begun. The play data detected here are processed in the same manner as the play data detected at step S81.

At step S83, the MIDI play data from the sequencer, the personal computer or the electronic musical instrument are received at the external input terminal, and are detected. Program control then advances to step S84. The play data detected here are processed in the same manner as the play data detected at step S81.

At step S84, the pitch of a voice signal input by the microphone or along the line is detected, and program control then advances to step S85. At step S85, a check is performed to determine whether automatic accompaniment for a musical tone, or a chordal harmonic mode for a harmonic voice has been designated. When either one has been selected, program control advances to step S86. If neither one has been designated, program control advances to step S88.

At step S86, the designated chord is detected from the play data for the part that is selected as the automatic accompaniment. At step S87, the chord play data that correspond to the designated chord are automatically generated, and program control advances to step S88.

At step S88, a musical tone signal is generated in accordance with the play data that have been entered, and a lead voice signal and a harmonic voice signal are produced in accordance with the voice that is input. Program control then advances to step S89.

In the automatic accompaniment mode, basically, the chordal harmonic mode is appropriate as a harmonic mode. At the time when both a musical tone signal based on the play data for the melody part and a lead voice signal based on the play data for the input voice are output, the tone signal and the harmonic voice signal are automatically played at a pitch consonant with a chord designated by a part selected as both the automatic accompaniment part and the harmony part. At this time, if a gender change is designated for the lead voice signal, the sound quality of the lead voice signal is changed (from a male to a female voice), and the pitch is also changed in accordance with the sound quality. If "auto" is set for the gender control of the harmonic voice signal, the sound quality of the harmonic voice signal is changed in accordance with the pitch difference with the input voice.

When the vocoder harmonic mode is selected, and when one of the parts such as automatic play part, the external input part or the key part of the keyboard operator is selected as a harmony part, the pitch of the input voice at the microphone is changed to the pitch of the harmony part and is then released. When a change of gender is designated, the sound quality of the harmonic voice is also changed.

At step S89, when pitch-to-note is designated, the pitch of a musical tone is determined based on the pitch of the input voice (at the same pitch or a pitch having a predetermined relationship), and a musical tone signal is generated using the timbre designated for the musical tone. Even for a user who has a bass voice, so long as an octave shift is designated for the pitch of the input voice, a melody can be generated at a high pitch having the timbre of a piano.

At step S90, the designated sound effect is provided and the waveform process is performed in accordance with other parameters. Program control thereafter returns to the main flowchart in FIG. 17.

In the above explanation, a male voice, a female voice or a neutral voice is employed as an example sound quality; however, the sound quality is not limited to a feature that sounds like a male voice, a female voice or a neutral voice. Further, in the explanation, the voice of a user has been employed as the input signal. However, the voice used may be the voice of an animal, or may be a musical tone signal. It should be noted that some musical tones include formants. For example, for the vibration of a piano string, the formant frequency is shifted in consonance with the pitch. Since an input signal is not limited to a voice, in the claims of the invention the term "timbre" is used as a concept that includes the above described sound quality.

An appropriate machine to which the voice signal/tone signal processing apparatus of the invention can be applied is: an amusement apparatus such as an electronic musical instrument, a game machine or a karaoke machine, that includes a function for entering a voice signal or a musical tone signal; various home appliances, such as a television; and a personal computer. The processing apparatus of the invention can be used as a voice signal/tone signal processor for these machines.

As apparent from the above description, according to the present invention, the clear timbre change, various pitch conversions, and the application of sound effects to an input signal can be easily performed to generate a new voice signal based on the input voice. A variety of music performance effects can be provided, including a unique effect that can be added by making an adjustment that permits instant play, and a chorus having correct intervals can be provided by a single singer. In this manner, various music play effects can be obtained.

What is claimed is:

1. A music apparatus for receiving an input signal composed of either of a voice signal or a tone signal and for processing said input signal based on a timbre change command signal to signal to generate at least one least one channel of an output signal, the music apparatus comprising:

a select and set section that selects a desired mode of a harmony and sets a desired type of the harmony of the selected mode, and that provides the timbre change command signal in association with the selected mode and the set type of the harmony;

a reference pitch designation section that designates a reference pitch; and an output signal generation section receptive of said input signal, said timbre change command signal and said reference pitch designated by said reference pitch designation section for changing a timbre of said input signal in accordance with said timbre change command signal, and for changing a pitch of said input signal above or below said reference pitch in accordance with said timbre change command signal, thereby generating the output signal having the changed timbre and the changed pitch to provide the selected mode and the set type of the harmony.

2. The music apparatus according to claim 1, wherein the output signal generation section changes the pitch of the input signal above the reference pitch when the timbre of the input signal is changed by converting an original formant of the input signal to a female formant, and the output signal generation section changes the pitch of the input signal below the reference pitch when the timbre of the input signal is changed by converting an original formant of the input signal to a male formant.

3. The music apparatus according to claim 1, wherein the select and set section selects a desired mode of the harmony from a plurality of preselected modes of harmonies and sets a desired type of the harmony of the selected mode among a plurality of preset types of harmonies.

4. A music apparatus for receiving an input signal composed of either of a voice signal or a tone signal and for processing said input signal in accordance with a timbre change command signal to generate at least one channel of an output signal, the music apparatus comprising:

a select and set section that selects a desired mode of a harmony and sets a desired type of the harmony of the selected mode, and that provides the timbre change command signal in association with the select mode and the set type of the harmony;

a pitch detection section that detects a pitch of said input signal; and an output signal generation section receptive of said input signal, said timbre change command signal and said pitch of said input signal that is detected by said pitch detection section for changing a timbre of said input signal based on said timbre change command signal and for increasing or decreasing said pitch of said input signal based on said timbre change command signal, thereby generating said output signal having the changed timbre and the changed pitch to provide the selected mode and the set type of the harmony.

5. The music apparatus according to claim 4, wherein the output signal generation section increases the pitch of the input signal when the timbre of the input signal is changed by converting an original formant of the input signal to a female formant, and the output signal generation section decreases the pitch of the input signal when the timbre of the input signal is changed by converting an original formant of the input signal to a male formant.

6. The music apparatus according to claim 4, wherein the select and set section selects a desired mode of the harmony from a plurality of preselected modes of harmonies and sets a desired type of the harmony of the selected mode among a plurality of preset types of harmonies.

7. A music apparatus for receiving an input signal composed of either of a voice signal or a tone signal or for processing said input signal in accordance with a chord designation signal to generate at least one channel of an output signal, the music apparatus comprising:

a plurality of pitch conversion tables corresponding to a plurality of harmony types, each pitch conversion table being stored for use in conversion of a pitch according to a chord;

a select section that selects a desired harmony type so that a pitch conversion table corresponding to the selected harmony type is specified;

a pitch determination section receptive of at least the chord designation signal which designates a chord for referring to said corresponding pitch conversion table to determine a pitch of said output signal based on the designated chord; and an output signal generation section receptive of said input signal for changing a pitch of said input signal to the pitch determined by said pitch determination section thereby generating said output signal having the determined pitch in the selected harmony type.

8. The music apparatus according to claim 7, wherein the select section selects a desired harmony type to determine a particular harmonic relation between said input signal and said output signal, said pitch determination section refers to a pitch conversion table corresponding to the selected harmony type to determine a pitch of said output signal, and said output signal generation section generates said output signal having the determined pitch in parallel to said input signal to establish the particular harmonic relation therebetween.

9. A music apparatus for receiving an input signal composed of either of a voice signal or a tone signal and for processing said input signal in accordance with a kit designation signal to generate at least one channel of an output signal, the music apparatus comprising:

a memory section that stores a plurality of parameter kits, each of which is constituted by a plurality of parameters used for characterizing said output signal and each of which includes at least a parameter used for controlling a pitch of said output signal;

a parameter output section receptive of said kit designation signal that designates one of the parameter kits for referring to said designated parameter kit to output therefrom at least said parameter used for controlling the pitch of said output signal; and an output signal generation section receptive of said input signal for changing a pitch of said input signal based on at least said parameter that is output by said parameter output section, thereby generating said output signal having the changed pitch.

10. The music apparatus according to claim 9, wherein said memory section stores a plurality of parameter kits in correspondence to a plurality of harmony modes including a vocoder harmony mode, a chordal harmony mode, a detune harmony mode and a chromatic harmony mode, each of which is used for characterizing a harmonic relation of said output signal to said input signal, said parameter output section refers to said designated parameter kit to output therefrom said parameters used for controlling said output signal, and said output signal generation section generates said output signal in parallel to said input signal to establish the harmonic relation therebetween according to the designated parameter kit.

11. A music apparatus for receiving an input signal composed of either of a voice signal or a tone signal and for processing said input signal to generate at least one channel of an output signal, the music apparatus comprising:

an effect setting section that sets parameters related to one or more sound effects to be applied to said output signal;

an effect instruction section that instructs application of at least one of said sound effects; and an effect applying section operative based on said parameters that are set by said effect setting section and that are related to said sound effect for processing said input signal to generate said output signal applied with said sound effect that is designated by said effect instruction section, said effect applying section generating said output signal in parallel to said input signal while applying said sound effect instructed by said effect instruction section to said output signal independently from said input signal.

12. The music apparatus according to claim 11, wherein said effect instruction section is manually operable to instruct application of a sound effect to said output signal independently from said input signal.

13. A method of processing an input signal composed of either of a voice signal or a tone signal based on a timbre change command signal to generate an output signal, the method comprising the steps of:

selecting a desired mode of a harmony and setting a desired type of the harmony of the selected mode;

providing said timbre change command signal in association with the selected mode and the set type of the harmony;

designating a reference pitch for an output signal;

receiving said input signal and said timbre change command signal;

changing a timbre of said input signal in accordance with said timbre change command signal; and changing a pitch of said input signal above or below said designated reference pitch in accordance with said timbre change command signal to thereby generate the output signal having the changed timbre and the changed pitch to provide the selected mode and the set type of the harmony.

14. A method of processing an input signal composed of either of a voice signal or a tone signal in accordance with a timbre change command signal to generate an output signal, the method comprising the steps of:

selecting a desired mode of a harmony and setting a desired type of the harmony of the selected mode;

providing said timbre change command signal in association with the selected mode and the set type of the harmony;

detecting a pitch of said input signal;

receiving said input signal and said timbre change command signal;

changing a timbre of said input signal based on said timbre change command signal; and increasing or decreasing said pitch of said input signal based on said timbre change command signal to thereby generate said output signal having the changed timbre and the changed pitch to provide the selected mode and the set type of the harmony.

15. A method of processing an input signal composed of either of a voice signal or a tone signal in accordance with a chord designation signal to generate an output signal, the method comprising the steps of:

providing a plurality of pitch conversion tables corresponding to a plurality of harmony types, each pitch conversion table for use in conversion of a pitch according to a chord;

selecting a desired harmony type so that a pitch conversion table corresponding to the selected harmony type is specified;

referring to said corresponding pitch conversion table based on a chord designated by said chord designation signal to determine a pitch of said output signal; and changing a pitch of said input signal to the pitch determined by use of said pitch conversion table to thereby generate said output signal having the determined pitch in the selected harmony type.

16. A method of processing an input signal composed of either of a voice signal or a tone signal in accordance with a kit designation signal to generate an output signal, the method comprising the steps of:

providing a plurality of parameter kits, each of which is constituted by a plurality of parameters used for characterizing said output signal, and each of which includes at least a parameter used for controlling a pitch of said output signal;

referring to one of said parameter kits designated by said kit designation signal to retrieve said parameter from said designated parameter kit; and processing said input signal to change a pitch of said input signal based on said parameter retrieved from said designated parameter kit, thereby generating said output signal having the changed pitch.

17. A method of processing an input signal composed of either of a voice signal or a tone signal to generate an output signal, the method comprising the steps of:

setting parameters that are related to one or more sound effects to be applied to said output signal;

instructing application of at least one of said sound effects; and processing said input signal based on said parameters that are set and that are related to said sound effect to generate said output signal which is applied with said sound effect upon instructing of the application of said sound effect and which is generated in parallel to said input signal while said sound effect is applied to said output signal independently from said input signal.

18. A medium for use in a music apparatus having a CPU, said medium containing a computer program executable by said CPU for causing said music apparatus to perform a method of processing an input signal composed of either of a voice signal or a tone signal based on a timbre change command signal to generate an output signal, wherein the method comprises the steps of:

selecting a desired mode of a harmony and setting a desired type of the harmony of the selected mode;

providing said timbre change command signal in association with the selected mode and the set type of the harmony;

designating a reference pitch for an output signal;

receiving said input signal and said timbre change command signal;

changing a timbre of said input signal in accordance with said timbre change command signal; and changing a pitch of said input signal above or below said designated reference pitch in accordance with said timbre change command signal to thereby generate the output signal having the changed timbre and the changed pitch to provide the selected mode and the set type of the harmony.

19. A medium for use in a music apparatus having a CPU, said medium containing a computer program executable by said CPU for causing said music apparatus to perform a method of processing an input signal composed of either of a voice signal or a tone signal in accordance with a timbre change command signal to generate an output signal, wherein the method comprises the steps of:

selecting a desired mode of a harmony and setting a desired type of the harmony of the selected mode;

providing said timbre change command signal in association with the selected mode and the set type of the harmony;

detecting a pitch of said input signal;

receiving said input signal and said timbre change command signal;

changing a timbre of said input signal based on said timbre change command signal; and increasing or decreasing said pitch of said input signal based on said timbre change command signal to thereby generate said output signal having the changed timbre and the changed pitch to provide the selected mode and the set type of the harmony.

20. A medium for use in a music apparatus having a CPU, said medium containing a computer program executable by said CPU for causing said music apparatus to perform a method of processing an input signal composed of either of a voice or a tone signal in accordance with a chord designation signal to generate an output signal, wherein the method comprises the steps of:

providing a plurality of pitch conversion tables corresponding to a plurality of harmony types, each pitch conversion table for use in conversion of a pitch according to a chord;

selecting a desired harmony type so that a pitch conversion table corresponding to the selected harmony type is specified;

referring to said corresponding pitch conversion table based on a chord designated by said chord designation signal to determine a pitch of said output signal; and changing a pitch of said input signal to the pitch determined by use of said pitch conversion table to thereby generate said output signal having the determined pitch in the selected harmony type.

21. A medium for use in a music apparatus having a CPU, said medium containing a computer program executable by said CPU for causing said music apparatus to perform a method of processing an input signal composed of either of a voice signal or a tone signal in accordance with a kit designation signal to generate an output signal, wherein the method comprises the steps of:

providing a plurality of parameter kits, each of which is constituted by a plurality of parameters used for characterizing said output signal, and each of which includes at least a parameter used for controlling a pitch of said output signal;

referring to one of said parameter kits designated by said kit designation signal to retrieve said parameter from said designated parameter kit; and processing said input signal to change a pitch of said input signal based on said parameter retrieved from said designated parameter kit, thereby generating said output signal having the changed pitch.

22. A medium for use in a music apparatus having a CPU, said medium containing a computer program executable by said CPU for causing said music apparatus to perform a method of processing an input signal composed of either of a voice signal or a tone signal to generate an output signal, wherein the method comprises the steps of:

setting parameters that are related to one or more sound effects to be applied to said output signal;

instructing application of at least one of said sound effects; and processing said input signal based on said parameters that are set and that are related to said sound effect to generate said output signal which is applied with said sound effect upon instructing of the application of said sound effect and which is generated in parallel to said input signal while said sound effect is applied to said output signal independently from said input signal.

* * * * *